US008251882B2

(12) United States Patent
Decker et al.

(10) Patent No.: US 8,251,882 B2
(45) Date of Patent: Aug. 28, 2012

(54) METHOD FOR OPERATING A LONGITUDINAL FOLDING APPARATUS HAVING A FOLDING BLADE AND A FOLDING TABLE, AND LONGITUDINAL FOLDING APPARATUS

(75) Inventors: Markus Wilhelm Decker, Worms (DE); Klaus Friederich, Kirchheim (DE); Christof Horst Höger, Worms-Horchheim (DE); Holger Ratz, Frankenthal (DE); Gerd Weiler, Kerzenheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 13/138,723

(22) PCT Filed: Dec. 23, 2009

(86) PCT No.: PCT/EP2009/067820

§ 371 (c)(1),
(2), (4) Date: Sep. 22, 2011

(87) PCT Pub. No.: WO2010/108559

PCT Pub. Date: Sep. 30, 2010

(65) Prior Publication Data

US 2012/0035032 A1 Feb. 9, 2012

(30) Foreign Application Priority Data

Mar. 27, 2009 (DE) ..... 10 2009 001 956
May 19, 2009 (DE) ..... 10 2009 003 235

(51) Int. Cl.
*B31F 7/00* (2006.01)

(52) U.S. Cl. ..... 493/419; 493/405; 493/444

(58) Field of Classification Search ..... 493/23, 493/29, 34, 405, 415–419, 443, 444
See application file for complete search history.

(56) References Cited

U.S. PATENT DOCUMENTS 3,589,709 A * 6/1971 Hey et al. ..... 493/10
3,926,425 A * 12/1975 Pierce et al. ..... 493/444
4,234,179 A * 11/1980 Weir ..... 493/14
4,419,088 A * 12/1983 Nemec ..... 493/444
4,481,007 A * 11/1984 Hornung ..... 493/444
4,496,337 A * 1/1985 Meenen ..... 493/14
4,549,728 A * 10/1985 Odeau ..... 270/46
4,573,671 A 3/1986 Reponty
4,578,052 A 3/1986 Engel et al.

(Continued)

FOREIGN PATENT DOCUMENTS

CA 2 168 799 A1 8/1996

(Continued)

*Primary Examiner* — Thanh Truong
(74) *Attorney, Agent, or Firm* — Mattingly & Malur, P.C.

(57) ABSTRACT

A longitudinal folding machine comprises a folding blade and a folding table. The folding blade is driven with a cyclical frequency relative to one or more elements of a web-processing machine, or relative to a flow of incoming products. The entry of a leading edge of products is detected at a first measurement point. A relative phase position between the movement of the folding blade and the phase position of the elements and/or the phase position of the flow of products is modified by one of a control and a regulation device to adjust a contact point of the folding blade with the products to be folded. The relative phase position is modified such that the leading edges of the products to be folded are maintained at a distance from the measurement point on the delivery route.

38 Claims, 15 Drawing Sheets

U.S. PATENT DOCUMENTS

| | | | | |
|---|---|---|---|---|
| 5,158,524 | A * | 10/1992 | Muto et al. | 493/417 |
| 5,167,604 | A * | 12/1992 | Ohsawa | 493/23 |
| 5,540,647 | A * | 7/1996 | Weiermann et al. | 493/444 |
| 5,628,718 | A * | 5/1997 | Huober | 493/29 |
| 6,283,471 | B1 | 9/2001 | Kunzel et al. | |
| 6,440,049 | B1 | 8/2002 | Belanger et al. | |
| 6,935,998 | B2 | 8/2005 | Silvestre | |
| 2007/0273087 | A1 * | 11/2007 | Ratz | 271/187 |

FOREIGN PATENT DOCUMENTS

| | | | |
|---|---|---|---|
| DE | 32 34 148 | A1 | 6/1983 |
| DE | 195 04 769 | A1 | 8/1996 |
| DE | 694 00 629 | | 2/1997 |
| DE | 198 56 373 | A1 | 8/1999 |
| DE | 199 50 603 | B4 | 5/2000 |
| DE | 100 63 528 | A1 | 2/2003 |
| DE | 10 2004 058 647 | A1 | 6/2006 |
| DE | 10 2005 007 745 | A1 | 8/2006 |
| EP | 0 161 988 | A1 | 11/1985 |
| EP | 0 462 421 | A1 | 12/1991 |
| EP | 0 639 523 | A1 | 2/1995 |
| GB | 2 281 069 | A | 2/1995 |

* cited by examiner

METHOD FOR OPERATING A LONGITUDINAL FOLDING APPARATUS HAVING A FOLDING BLADE AND A FOLDING TABLE, AND LONGITUDINAL FOLDING APPARATUS

CROSS-REFERENCE TO RELATED APPLICATIONS

This application is the U.S. national phase, under 35 U.S.C. 371, of PCT/EP2009/067820, filed Dec. 23, 2009; published as WO2010/108559 A1 on Sep. 30, 2010; and claiming priority to DE 10 2009 001 956.1, filed Mar. 27, 2009, and to DE 10 2009 003 235.5, filed May 19, 2009, the disclosures of which are expressly incorporated herein by reference.

FIELD OF THE INVENTION

The invention relates to a method for operating a longitudinal folding apparatus having a folding blade and a folding table, and a longitudinal folding apparatus. The folding table has a folding gap which is bounded, on its two sides, by at least one, or a group of brake elements. The movement of the folding blade is driven by a synchronized motor, with respect to its cyclic motion frequency, in relation to one or more units of a web-processing machine that is situated upstream, and/or in relation to a flow of incoming products. The entry of a leading edge of incoming products is detected at a first measuring point in the transport path of the folding table. A relative phase position between the movement of the folding blade and the phase position of the unit or units upstream and/or the phase position of the flow of products is deliberately modified by a control system and/or a regulation system for the purpose of adjusting a point of contact of the folding blade with the product to be folded. The products to be folded can be fed from a first, intake side of the folding table and along a first direction of transport, which is preferably parallel to the plane of the folding table. The first measuring point is at, or immediately upstream of, a stop surface which, in an activated state, restricts the transport path. A second measuring point, which lies closer to the intake side, is provided, together with the regulation and/or control system that is assigned to the folding blade drive.

BACKGROUND OF THE INVENTION

From DE 10 2005 007 745 A1, a longitudinal folding apparatus is known, wherein the folding table is equipped with a braking device, for example, a braking brush, on each side of the folding blade, for the purpose of preventing the product that will be folded from striking the stop at full speed. Instead, the product is to be decelerated in a specified manner via the braking device, and aligned in a specified manner at the stop. In this case, each braking brush is mounted on a support and is displaceable via actuators, wherein the two braking devices are connected in such a way that they can be moved away from the folding table together.

DE 694 00 629 T2 discloses a longitudinal folding apparatus comprising a folding blade and a stop that delimits the folding region on the folding table. Also provided is a brush braking device with brushes, wherein a servo unit is provided for adjusting the brush pressure of each brush or group of brushes. Two sensor systems spaced transversely to the product direction are provided, one on either side of the folding blade, with each such system on one side of the product path comprising a plurality of detectors, spaced in the direction of transport by 1 mm, for example, and each such system on the other side of the product path comprising an infrared source that illuminates the respective sensor system. The measuring range for these sensor systems extends over the stop and a region lying upstream thereof on the product side. By analyzing the degree of coverage and a distance from the stop, and optionally the temporal sequence of coverage in the folding process, a potentially flawed braking effect can be identified and automatically corrected. A comparison of the distance between stop and product edge over the degree of coverage of the two sensor systems makes it possible to monitor the leading edge with respect to a skewed or improper alignment. Using a control apparatus that contains the sensor systems, the effect of the braking device is adjusted on the basis of the reading from the sensor device such that the folding blade acts on every product that is optimally aligned in the folding region, wherein the leading edge comes to rest at the end face of the stop in such a way that the printed product is not damaged and is folded precisely. In this, the folding blade moves in phase displacement relative to the forward movement of the printed product, and therefore, it moves downward so as to engage with the upper side of each printed product when said product is entirely within the folding region, wherein the leading edge comes to rest directly at or very close to the end face of the stop. It is also observed in DE 694 00 629 T2 that for folding apparatuses in which the braking effect is achieved solely by the folding blade, the braking effect can be regulated by modifying the phase timing of the folding movement thereof.

From EP 2 017 210 A2, a longitudinal folding apparatus and a method for operating the longitudinal folding apparatus are known, wherein two speeds are determined by means of two detector systems, one in front of the other in the direction of transport, and the product to be folded longitudinally is decelerated from the first speed to the second speed via frictional contact exerted on the printed product, for example, via the folding blade, as the printed product moves along a braking path on the folding table. The time for starting the frictional contact that decelerates the printed product, for example, the first contact of the folding blade, is adjusted on the basis of a deviation of a determined actual value for the second speed of the printed product from a predetermined target value for this second speed. The goal in this is to ensure that the product will strike the stop for the braking and alignment of said product.

DE 198 56 373 A1 relates to an early warning system and a method for detecting jams of imprinted signatures. For this purpose, sets of sensors are provided downstream of the cross cutter of the cross folding apparatus, each upstream of two longitudinal folding apparatuses. When a skewed position is detected, an error message is sent out and the printing press is slowed or stopped.

From DE 100 63 528 A1, a method and a device for determining the accuracy of a folding position is disclosed, wherein markings imprinted onto the shingle flow are detected in the product output, and the position of said markings relative to the fold spine allows a conclusion to be drawn regarding fold quality. This can then be used by the operator as a tool for diagnosing defects, and also allows feedback on folding accuracy to be sent to the folding apparatus. When errors occur, such as skewed folds or overhanging paper, measures can be introduced for increasing folding accuracy, such as correcting a phase position of folding blade to folding jaw, regulating a speed of the transport element that transports the flow of shingles, or even shutting off the printing press, for example.

In DE 10 2004 058 647 A1, a buckle folding machine having a sensor is disclosed, wherein the sensor, or two sensors spaced transversely to the direction of conveyance, characterize the process for the incidence of the leading edge of a workpiece. The sensor or sensors can be embodied as a microphone, as an acceleration sensor, as strain gauges, or as ultrasonic sensors. In the latter case, the concept is to allow orientation signals to be generated that characterize the orientation of a leading edge being moved toward the pocket stop. Positioning means for adjusting the orientation of the pocket stop are actuated on the basis of the measured values from the sensor or sensors.

DE 32 34 148 A1 relates to a method and a device for inspecting folded sheets for deviations of the fold line from the target fold line on the basis of the type area in buckle or blade folding apparatuses. For this purpose, two sensors are provided in the flow of folded products, spaced transversely to the flow, and detect the distances between fold marks applied to the product and the fold edge, wherein an analysis unit uses this information to calculate and/or display a mean value deviation from the target value for longitudinal and angular deviations in the fold, and/or to utilize said deviation for the purpose of controlling the machine. This enables a selective correction of adjusted machine values.

From DE 199 50 603 B4, an infeed of sheets that are to be imprinted into a printing couple of a sheet-fed printing press is disclosed, wherein, by means of two ultrasonic sensors spaced transversely to the flow, information about the position of an individual sheet to be fed into the printing couple is provided before said sheet is fed by a gripper to the printing couple. In this manner, a skewed position or an undesirable double layer can be detected, which is coupled to a control and regulating device that is connected to the gripper.

EP 0 161 988 A1 proposes a longitudinal folding apparatus, in which only one sensor is provided, directly at the stop. The products entering on the folding table are controlled by adjusting the phase between product and folding blade contact, such that the product reaches the stop in a straight alignment. This is achieved by means of a relay circuit. If the products do not reach the sensor, the phase of the blade is adjusted to a later time, until the products are visible at the sensor. If the machine speed is increased by a control command input by the press operator, pressing the switch will also actuate a relay at the same time, so as to shift the point of contact of the blade to an earlier time. However, afterward the above-described automatic system re-engages, which again shifts the time point back until the sensor again "sees" the product. This procedure is intended to improve a prior art, which operates in a "floating" manner with two sensors, wherein one sensor is used for increasing the forward movement and the other is used for decreasing the forward movement.

From EP 0 462 421 A1, a method and a device for controlling the movement of the longitudinal folding blade are known, wherein at the stop, an acceleration sensor is disposed, which senses the accelerations of the incoming product. If the measured acceleration deviates from a target value, the folding time is adjusted. If the acceleration value detected by the sensor is too great, the folding time is shifted forward, and if it is too small, it is shifted backward.

DE 195 04 769 A1 relates to a longitudinal folding apparatus, wherein first sensors are provided at the front side of the stop, which sensors measure the distance of the leading edge as the product to be folded is conveyed thereto, and a control circuit analyzes, via comparison, whether the two halves are approaching at the same speed. If one side approaches the stop more quickly, the braking assembly assigned to this side will be brought closer to the folding table, in order to brake this side with greater force. Additional sensors are provided for measuring undulations in the folded copy. When embodied as optical sensors, these sensors that measure undulation can detect the distance from the upper side of the product, or, as strain gauges, they can measure the force exerted on them by the deformation of the upper side. If a maximum value is exceeded, the position of the braking devices is adjusted. In a further embodiment, additional sensors can be provided at the stop, by means of which a deformation of the leading edge can be detectable. In one embodiment, the stops can also be embodied as circular arches, or as rotatable about fulcra. The measured deformations are also to be suitable as control or regulating variables, for controlling and/or regulating the movement of the folding blade.

SUMMARY OF THE INVENTION

The problem addressed by the invention is that of devising an improved method for longitudinally folding a product on a folding table of a longitudinal folding apparatus, and a longitudinal folding apparatus suitable for this purpose.

The problem is solved according to the invention by the modification of the relative phase position using a control algorithm such that, at least in one operating mode or phase of production operation, the leading edges of the products to be folded, which are conveyed on the folding table, are held back at a distance from the measuring point which is located on the transport path by varying the relative phase position. This is done in such a way that, as a result of a detection of a leading edge of one or of a certain number of successive products at this measuring point, the relative phase position is varied to an earlier time for the first contact of product and folding blade, and/or the contact point is varied to a point that lies closer to an intake side of the incoming product. At a second measuring point, which is located upstream of the first measuring point, in the direction of transport, the entry of a leading edge of incoming products is also detected. The relative phase position is varied using a control algorithm in such a way that, at least in one operating mode or phase of a production operation, the leading edges of the products to be folded, which are conveyed on the folding table, are held in a capture area, which is defined by the two measuring points that are spaced from each other in the direction of transport. This is done by varying the relative phase position and, with single or multiple deliveries from the capture area, the position of the edge of this capture area is moved back for subsequent products. A skewed position of the product to be longitudinally folded is corrected by a friction-based deceleration implemented by the braking elements that are disposed on both sides of the folding gap and that are adjustable independently of one another in terms of the distance from the folding table or from the upper side of the folding table and/or from the product. The folding blade has a folding blade drive which is mechanically independent of at least one transport device that is situated upstream of the folding gap and which is provided for conveying the products to, into, or within the longitudinal folding apparatus. The regulating and/or control system is embodied with the algorithm to modify a relative phase position between the folding blade drive and the product flow on the basis of signals that detect the presence of a product leading edge at the first and second measuring points. The product leading edge of a subsequent product can still be detected only at the second measuring point. The braking elements or groups of braking elements, which are disposed on each of the two sides of the folding gap, can be adjusted independently of one another in terms of their distance from the folding table, or from the upper side of the folding table or from the products.

The advantages that can be achieved with the invention consist especially in that a longitudinal folding apparatus, in web-fed rotary printing presses also referred to as the "third fold" or the "second longitudinal fold", is provided which allows higher outputs and less stringent requirements for manual interventions while still producing good fold quality.

For this purpose, a lever folding blade system is used, with sensor-controlled folding time regulation (e.g., folding time control of the folding blade), for example, and/or a sensor-controlled skew regulation (correction of skew using brushes), for example, with four motor-driven brush systems that are incorporated into an automatic control system.

Of particular advantage with respect to high fold quality and low risk of failure are precautionary measures with respect to optimal positioning during folding. This relates to the position on and/or under the folding table. The corresponding control or corresponding controls make it possible to carry out proper folding largely independently of factors such as belt wear, paper type, page numbers, ink application, and/or surface coating of the printed product.

With a control concept that is adapted to operating modes and/or phases, an optimal adjustment to requirements can be achieved.

It is particularly advantageous that potential damages to the product to be folded are counteracted by the method and the longitudinal folding apparatus.

BRIEF DESCRIPTION OF THE DRAWINGS

Embodiment examples of the invention are illustrated in the set of drawings and will be specified in greater detail in what follows.

The drawings show.

DESCRIPTION OF THE PREFERRED EMBODIMENT

Figure 1:
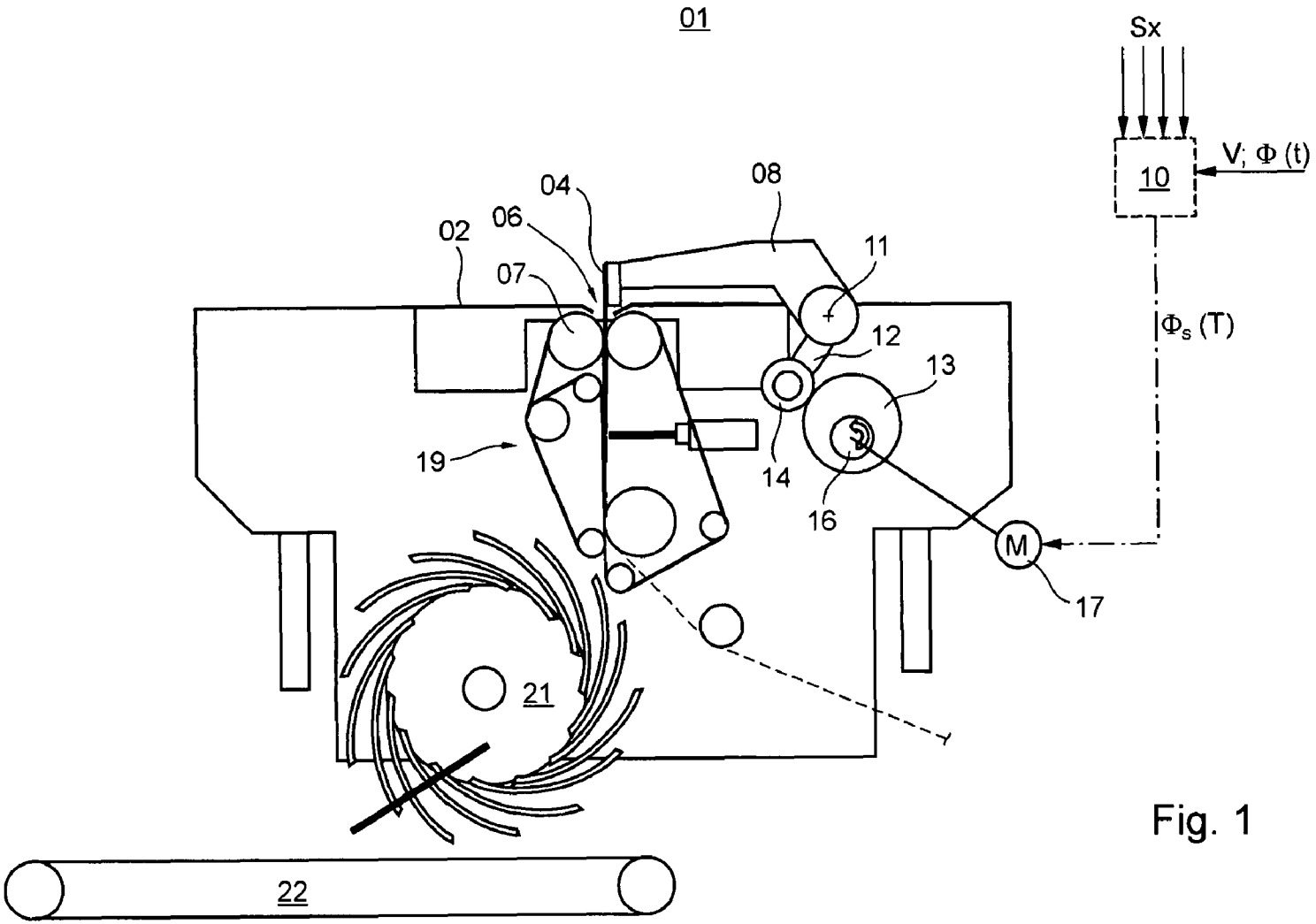
FIG. 1 a schematic sectional view of a longitudinal folding apparatus.
Figure 2:
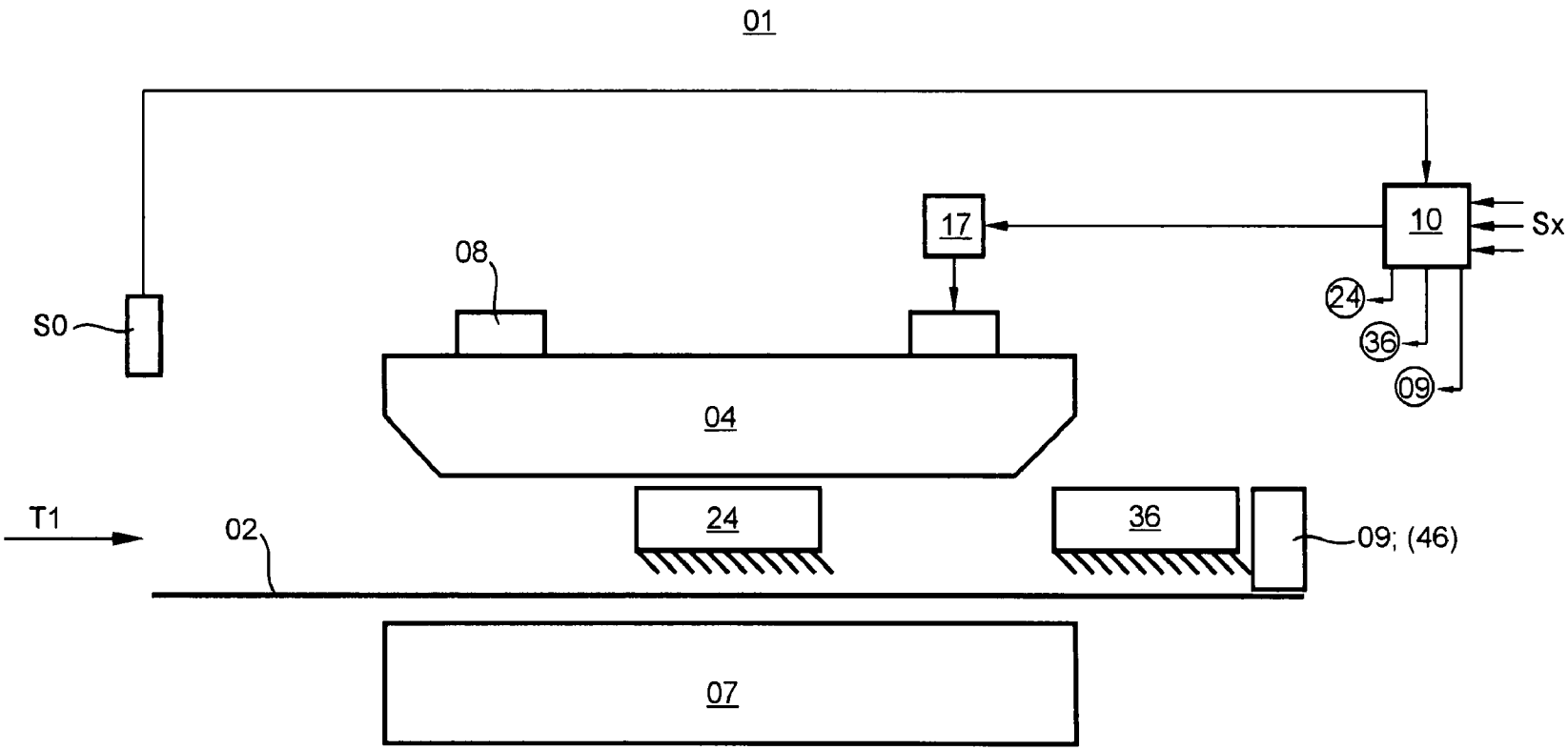
FIG. 2 a schematic side view of a longitudinal folding apparatus.
Figure 3:
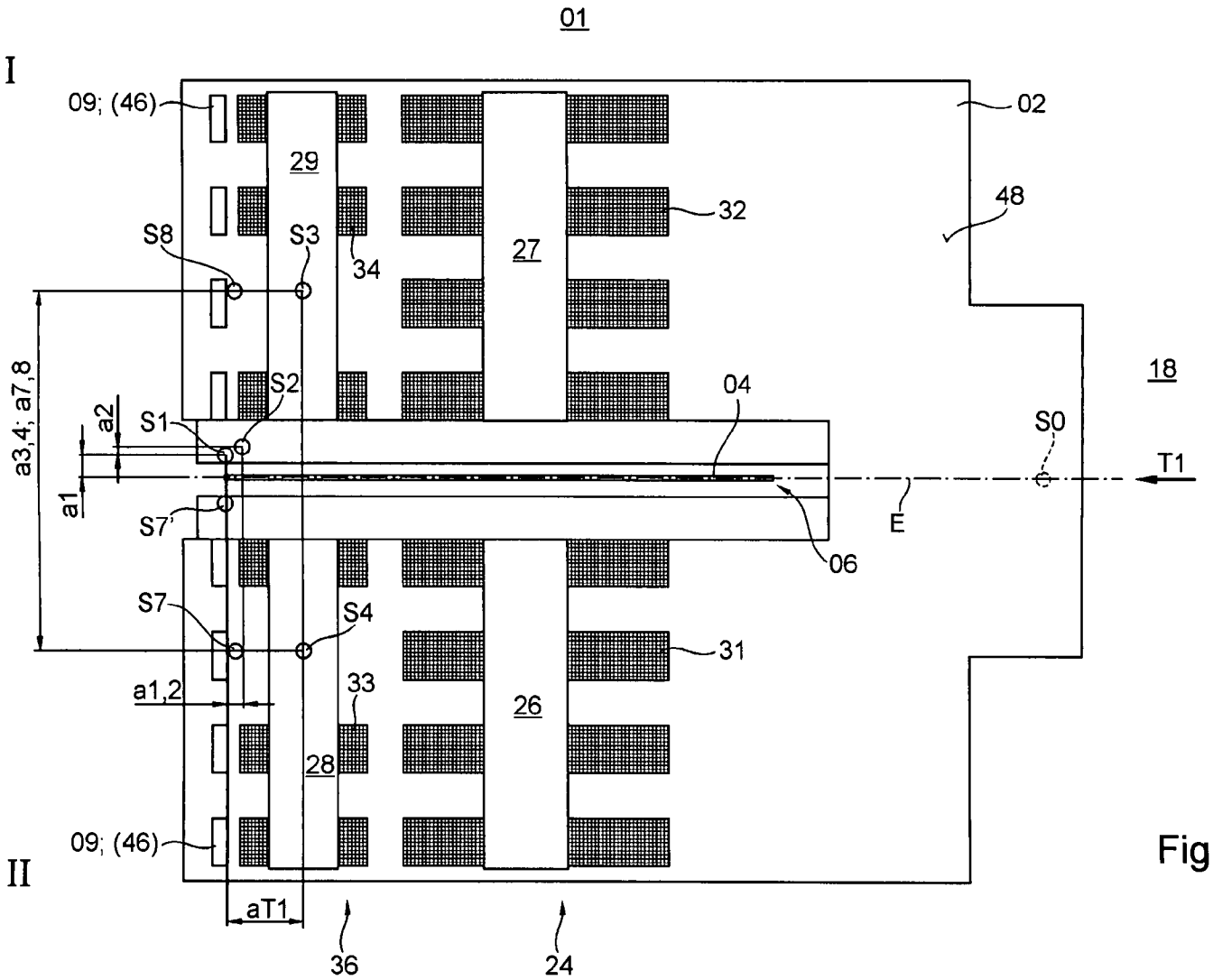
FIG. 3 a schematic plan view of the folding table of a longitudinal folding apparatus.
Figure 4:
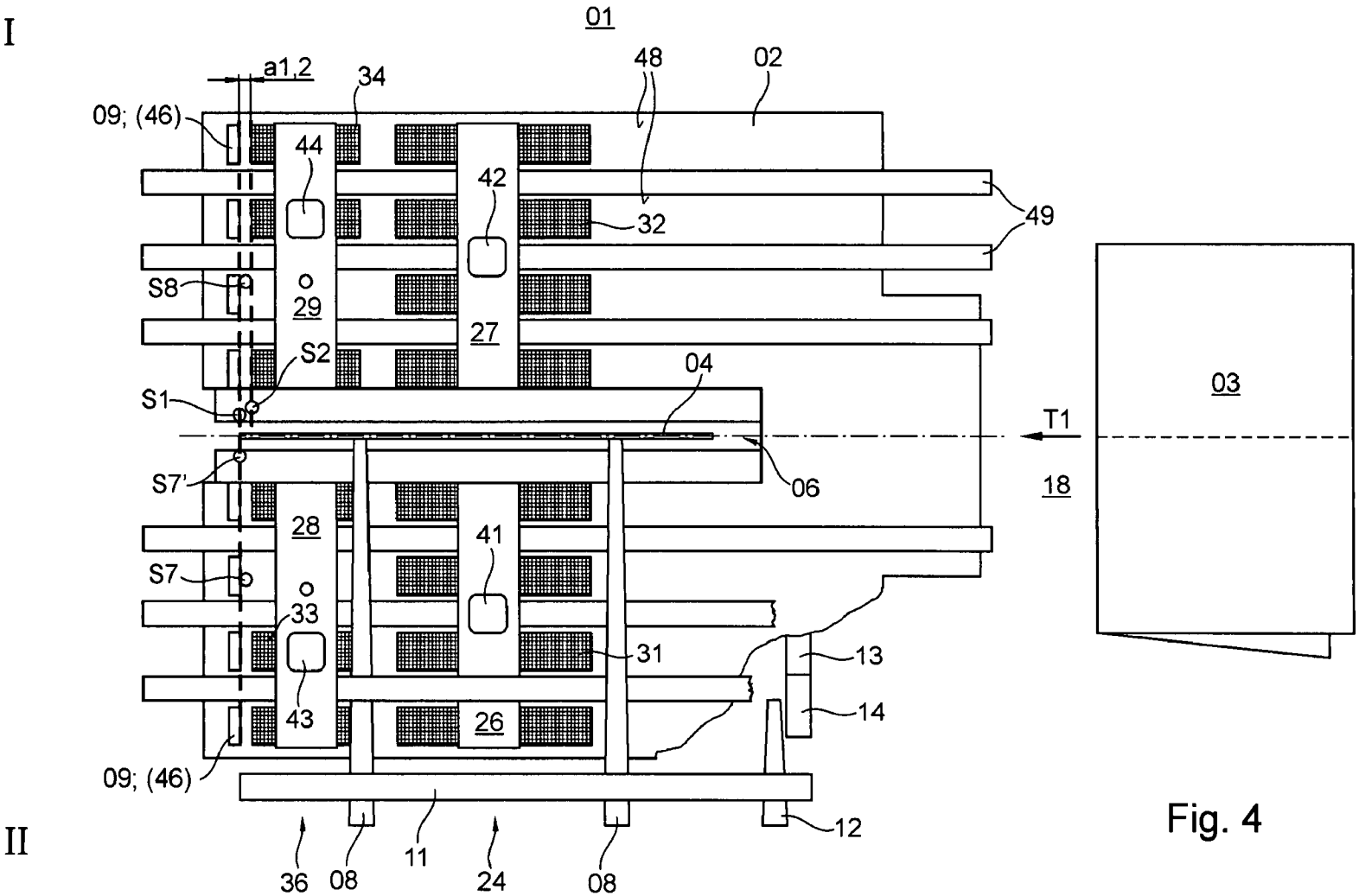
FIG. 4 a schematic plan view of the folding table of a longitudinal folding apparatus with a product entering in a straight alignment.
Figure 5:
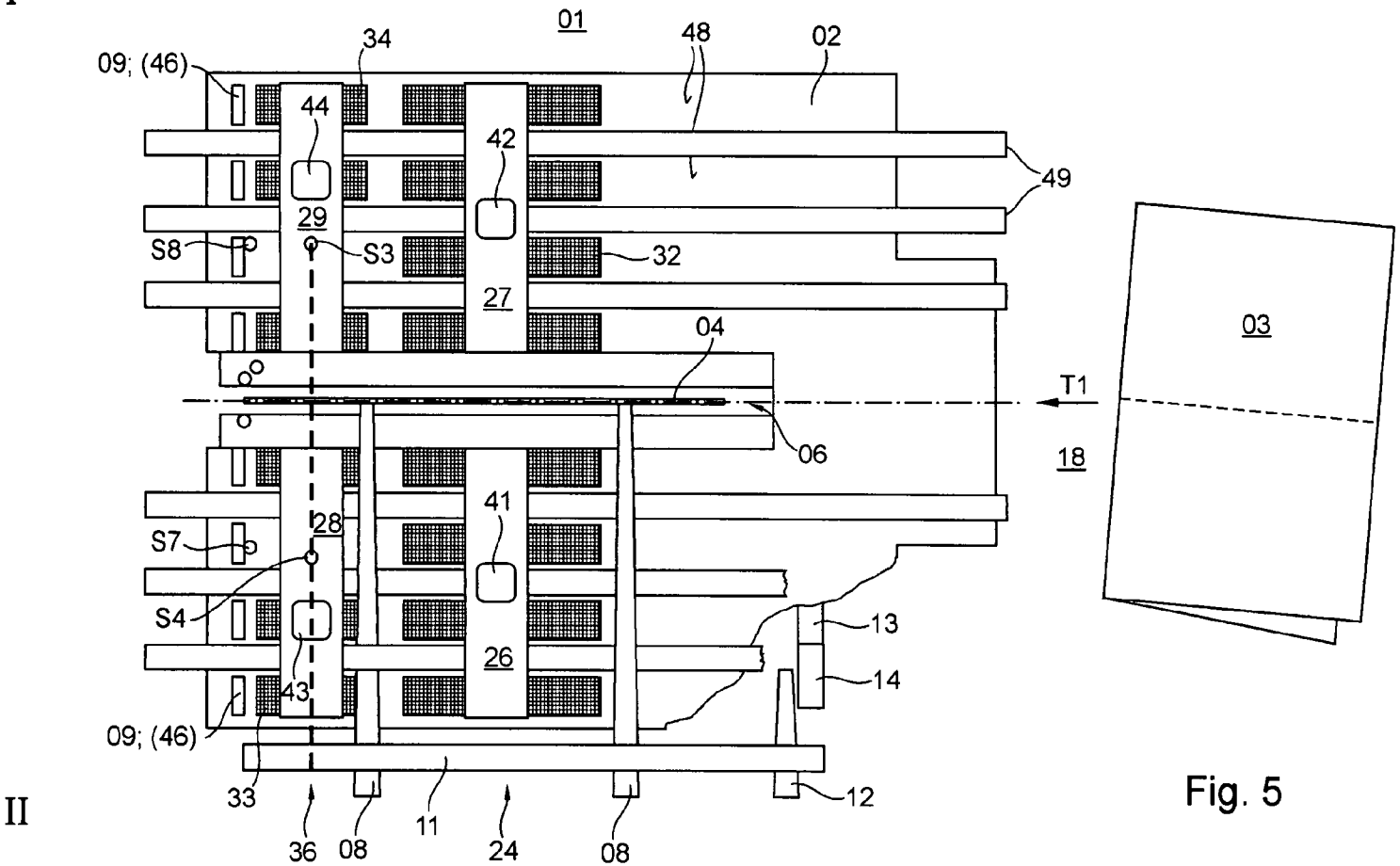
FIG. 5 a schematic plan view of the folding table of a longitudinal folding apparatus with a product entering in a skewed alignment.

FIG. 1 shows a simplified sectional view of a processing stage 01, embodied as a longitudinal folding apparatus 01, or a folding apparatus 01 (without details such as brush systems, for example, specified in greater detail below), FIG. 2 shows the same in a simplified view from the side, and FIGS. 3 to 5 show the same in a schematic plan view. The longitudinal folding apparatus 01 comprises a folding table 02 or an upper side of the folding table 02, in which an elongated folding gap 06 is provided, more particularly, parallel to a first direction of transport T1 of a product 03 entering the longitudinal folding apparatus 01 from an intake side 18. This product 03 or intermediate product 03 is a product section, for example, optionally previously longitudinally and/or cross folded, of a printed product imprinted in a web-processing machine, preferably a printing press, particularly a web-fed rotary printing press.

Under the folding table 02, at the level of the folding gap 06, a pair of folding rollers 07 (FIGS. 1, 2 and 3) is disposed in such a way that the rollers form a nip, oriented parallel to the folding gap 06 and located directly below this. For folding the product 03, a folding blade 04 is provided, also oriented parallel to the folding gap 06, which is inserted into and withdrawn from the folding gap 06 by an up and down motion. For this purpose, pivotable levers 08, for example, folding levers 08, which support the folding blade 04, can be mounted on the longitudinal folding apparatus 01. By pivoting the folding levers 08, the folding blade 04 can be inserted into the folding gap 06. At an end region of the folding table 02 and/or the folding gap 06, a single-piece or segmented stop device 09 is provided, which, in the active position thereof, restricts the path of the product 03, wherein the stop surface—whether single or in multiple sections—that faces a product 03 extends essentially in a line transversely to the alignment of the folding gap 06.

In contrast to a rotating blade—the folding blade 04 is preferably embodied as a blade 04 which, with respect to the folding table 02, can be moved up and down relative to the folding table 02, for example, pivotable. The blade 04 is mounted on the folding levers 08, for example, which are in turn pivotable about an axis 11 in relation to the folding table 02. In another embodiment, however, the blade 04 can also be disposed eccentrically on a continuously rotating rotational body. It can also be disposed eccentrically on a rotating planetary gear. In a preferred embodiment, however, for moving the folding blade 04, regardless of the mechanical or physical configuration thereof, a drive that is mechanically independent of the drive of the units situated upstream (such as the drive of printing units and/or the drive of a cross-folding apparatus and/or the drive of conveyor devices situated upstream of the folding process, for example), particularly a drive means 17, for example, a drive motor 17, which is independent of these units, is provided.

In the folding step, the product 03 to be folded, for example, the printed product 03, is pressed by the folding blade 04 through the folding gap 06 into the gap between the two folding rollers 07, for example, the folding roller nip, and is thereby folded longitudinally, after which it is conveyed by a belt system 19 either to a fan wheel 21 and from there to a delivery apparatus 22, or, as indicated by dashed lines, is diverted in a different direction.

The folding blade 04 is preferably driven via a cam mechanism. For this purpose, the folding blade 04 is disposed on the lever 08, which is mounted so as to pivot on a fulcrum, for example, the axis 11. The lever 08 can be embodied either as a lever arm 08 of a lever embodied as a double lever having a second lever arm 12, or as a single-arm lever, in which case the second lever 12 is then non-rotatably connected to the rotatably mounted axis 11. At the end of the second lever 12 (or the second lever arm 12) that is distant from the fulcrum, a stop 14, embodied as a cylinder 14 mounted rotatably on the lever 12, for example, and interacting with the outer curve of a rotatable body 13, for example, a cam disk 13, is disposed. The cam disk 13 is mounted non-rotatably on a shaft 16, which can be rotationally driven directly or via gearing by the drive motor 17, indicated only schematically.

The outer curve of the cam disk 13 can preferably be embodied as irregular and asymmetrical in relation to its rotational axis, which produces a corresponding movement of the folding blade 04 with rotation via the crank mechanism (levers 08 and 12). In the illustration of FIG. 1, the cam disk 13 is embodied as a circular disk with a circular periphery, which is disposed eccentrically on the shaft 16. Thus, regardless of the embodiment of the cam disk 13, the rotation thereof produces a specific up and down movement of the folding blade 04, the motion profile of which with the constant rotation of the shaft 16 or of the drive motor 17 is clearly predefined, however, the speed of the cycle of this fixed motion profile is adjustable on the basis of the driving speed of the shaft 16 or of the drive motor 17. Therefore, during operation, the blade 04 continuously goes through a periodically recurring series of motions in its up and down movement, wherein the phase length (period length) represents a complete up and down movement up to the next same phase position having the same direction of motion, and the frequency thereof is determined by the specification of the driving speed of the shaft 16 or of the drive motor 17, and can preferably be adjusted.

In a preferred embodiment, therefore, a separate drive means 17, for example, which is mechanically independent of the conveyor and/or production units (such as conveyor or transport belts for conveying the product 03 and/or printing couples and/or a cross-folding apparatus situated upstream) that are situated upstream of the longitudinal folding apparatus 01, is assigned to the folding blade 04. The drive means 17 can then be embodied in the above-described manner as a drive motor 17, which lowers and raises the folding blade 04 in a cycle to a desired position of a product 03 on the folding table 02, by means of a transmission, for example, a cam mechanism, an eccentric or a crank mechanism. In a further development, the folding rollers 07 are also rotationally driven by the drive motor 17 via a mechanical drive connection, for example, via a gear wheel connection from the shaft 16. In addition, the fan wheel 21 and/or optionally even the delivery apparatus 22 could also be driven by the drive motor 17 via corresponding drive connections. Advantageously, however, the fan wheel 21 has its own drive motor 17, not shown here. To stop the longitudinal folding apparatus 01 or the drive or drive motor 17 thereof, a stop brake can be provided, which interacts with a brake disk that is connected non-rotatably to a motor shaft or to the folding blade drive, for example, to the shaft 16 or the cam disk 13.

The drive 17 is controlled, for example, by a control and/or regulating system 10, or control system 10, which is assigned fo the folding blade drive (and/or to the folding roller drive, if these are driven together) and is indicated only schematically in FIG. 1 as a box, and which uses information specified in greater detail below and relating to a speed V of the printing press or to a conveyor path that conveys the product 03 to the and/or into the folding apparatus 01 and/or uses information from sensors Sx (see below) to control the drive of the folding blade 04 in such a way that the movement of the folding blade 04 can be synchronized in a desired manner with the flow of the products 03 entering the longitudinal folding apparatus 01, and if applicable, the synchronization is or can be deliberately varied or corrected as needed in terms of the relative phase position $\Delta\Phi$ thereof.

Preferably, the folding blade 04 is driven in the stationary operating mode, with its folding frequency synchronized with the flow of product to be supplied to the folding apparatus 01. In principle, this synchronization can be oriented in terms of its speed V to a speed V of the printing press situated upstream, or to the drives thereof, for example, to a unit of the printing press, to a folding apparatus situated upstream, or to a conveyor section situated upstream for conveying the products 03. In a simpler embodiment, basic synchronization with respect to folding frequency, for example, the speed of the drive motor 17, can be implemented, for example, by means of sensing elements, with systems situated upstream, for example, with a moved part of the conveyor section, or on the basis of the rate of the incoming products 03, or, as described in what follows, by means of an electronic guide axis. All of this is to be understood generally as included in the information provided to the control system 10 with respect to a speed V. A desired relative target phase position $\Delta\Phi_R$ or target relative position $\Delta\Phi_R$, for example, target reference phase position $\Delta\Phi_R$, between folding blade movement and product entry can be adjusted and modified by a relative phase adjustment between the incoming flow of product and the angular position $\Phi_A$ of the drive of the folding blade 04, particularly by "rotating" the drive motor 17.

If, in a preferred manner, drives of units of said printing press are driven synchronously via an electronic, particularly "virtual guide axis", then the at least speed-synchronized driving of the folding blade 04 is advantageously carried out on the basis of data, more particularly, data relevant to speed and/or angular position, from the electronic or virtual guide axis. These data can be based on angular positions of a rotating guide axis, on angular speeds and/or on a predefined speed, which is indicated in FIG. 1 as rotating angular position $\Phi(t)$ or more generally as speed V. These guide axis data are processed, for example, in a control module 23 assigned to the drive motor 17, for the direct actuation of the drive motor 17 or of a control loop that controls the position and/or speed of the drive motor 17. The control module 23 can be embodied as a purely software-based control process 23 within a control device comprising a plurality of control processes of this type or different types, or as a structurally separate unit, for example, having its own housing, or as a card, as a so-called drive control mechanism 23, or as a part thereof. It can also be disposed decentralized and close to the drive (for example, integrated into the drive control mechanism 23), or can be disposed (partially) centrally, together with corresponding control mechanisms for other drives. In the figures, the control module 23 is represented as part of a control device, identified overall as control system 10, the components of which are provided in a shared control means, for example, a logic circuit configuration (e.g., SPS) and/or data processing means (e.g., computer, PC), or in a plurality of control means, for example, logic circuits (e.g., SPS's) and/or data processing means (e.g., computers, PC), which are connected to one another for the purpose of signals transmission.

A signal conditioning of the guide axis data, as described above, in the control module 23 and/or the control system 10, for example, is implemented, for example, taking into consideration a geometry-based offset value $\Delta$ (e.g., correction angle $\Delta$) and/or a transmission factor G. The former ($\Delta$) ensures the relative phase position between, for example, the angular position of the rotating guide axis $\Phi(t)$ (or of a unit that provides the position and/or cycle) and the folding blade position for the correct folding time, and the latter (G) synchronizes the phase length (period length) of the guide axis revolution or the machine movement that follows this (product production, for example, via printing couple drive) with that of the folding blade movement, such that within a certain time frame, the folding blade 04 runs through the same number of periods as the number of products 03 that can and will enter into the longitudinal folding apparatus 01. An increase in the speed V, particularly in the production speed V (or guide axis speed $d\Phi(t)/dt$), then synchronously effects a corresponding increase in the folding blade rate. In addition to the synchronized speed V and phase length, however, the relative phase position between the incoming product 03 and the phase position of the folding blade 04, as described above, are highly significant to the folding process. This is ensured by an offset value Δ as described above, which can be manually or automatically determined and/or adjusted before or at the start of production, for example, in the manner specified below, for example. The above-described target relative position $\Delta\Phi_R$ to be adjusted is entered into the offset value Δ, for example, or corresponds thereto even if no other geometrically based offset variables are to be taken into consideration. The target relative position $\Delta\Phi_R$ to be adjusted can be monitored and maintained by means of a control loop that compares and, if necessary, corrects the flow of product (e.g., by means of an input-side sensor S0) and the folding blade phase position (e.g., at the drive thereof).

An operation synchronized accordingly with respect to a target relative position $\Delta\Phi_R$ to be maintained can then be defined as follows, for example:

The longitudinal folding apparatus 01 or the folding blade 04 thereof is driven by the drive motor 17, which is mechanically independent of the conveyor section upstream, which conveys products 03. When a deviation occurs in the relative phase position, i.e., in the actual relative position $\Delta\Phi_I$ between the product phase position $\Phi_P$, for example, determined at an "input sensor", for example, a sensor S0 at the intake point 18 or on the conveyor section situated upstream, and the angular position $\Phi_A$ of the folding blade drive, for example, of the drive or the drive motor 17, from the target relative position $\Delta\Phi_R$ specified previously, a correction is carried out by means of a relative phase adjustment between conveyor section drive and folding blade drive, for example, by means of a relative rotation of the folding blade drive about a correction angle Δ. This can be accomplished, for example, by operating the drive motor 17 that drives the folding blade 04 faster or slower, depending on the deviation, than the speed V, for example, the speed that corresponds to the machine speed or the conveyance speed, for a limited amount of time, until the target relative position $\Delta\Phi_R$ has again been reached. In the case of the above-described embodiment comprising an electronic guide axis, for example, the offset value Δ is varied accordingly by a correction value in order to restore the target relative position $\Delta\Phi_R$ or the resulting target angular position $\Phi_S$. This internal control loop for maintaining a predefined target relative position $\Delta\Phi_R$ or target angular position $\Phi_S$ is not illustrated separately in FIG. 6. To maintain a target relative position $\Delta\Phi_R$, this control loop therefore controls the phase position of the folding blade 04, particularly the drive motor 17 thereof, relative to the product 03, on the basis of the time of arrival of the product 03 at a sensor provided for this purpose, for example, a sensor S0 situated upstream of the folding blade 04. For this purpose, for example, by means of the sensor S0, a signal that represents the intake or optionally the output of a product 03 is detected, an angular position $\Phi_A$ occupied by the drive motor 17 at the time of the signal is detected, from this motor angular position and a zero angular position of the drive motor 17, the actual relative position $\Delta\Phi_I$ is determined, for example, and this actual relative position $\Delta\Phi_I$ is compared with the target relative position $\Delta\Phi_R$ that is to be maintained, and in the event of a deviation as described above, a phase adjustment is implemented using a correction angle Δ.

Preferably—as will be specified in greater detail below—in the production mode, the longitudinal folding apparatus 01 is operated in such a way that a first contact of the conveyed product 03 by the folding blade 04 occurs while the product 03 is still moving on the folding table 02 and is located upstream of the stop 09; (or 46, see below).

At the start of production, a ("basic") synchronization of the folding blade phase with the product phase can be advantageous. In this case, for example, at a set-up speed that is slower than a production speed, a product 03 is first conveyed to an intended contact position on the folding table 02, and, once it reaches the intended contact position, while the conveyor section is idle, the drive or drive motor 17 of the folding blade 04 is rotated until the folding blade 04, in the phase of movement toward the product 03, comes into contact with the product or is nearly in contact with it (first contact). In this case, the angular position $\Phi_A$ occupied by the folding blade drive or drive motor 17 for the contact position, for example, is then retained as the zero angular position (for the folding time), and then, when the conveyor section is active, the sensor S0, for example, detects an intake signal (or outlet signal) of a product 03 upstream of the folding table 02 or upstream of the folding gap 06, the angular position $\Phi_A$ occupied by the drive or drive motor 17 at the time of the signal is established as the reference position $\Phi_R$, and from the zero position and the reference position $\Phi_R$ the target relative position $\Delta\Phi_R$ (target reference phase position $\Delta\Phi_R$) that is predefined for further operation is formed. This is then maintained via the above-described control loop. In the case of an electronic guide axis, said target relative position is entered into the offset value Δ (e.g., expressed as $\Delta(\Delta\Phi_R)$ or itself represents this value ($\Delta=\Delta\Phi_R$), wherein the drive motor 17 is operated with corresponding angular position control, taking this offset value Δ or this target relative position $\Delta\Phi_R$ into consideration.

Figure 6:
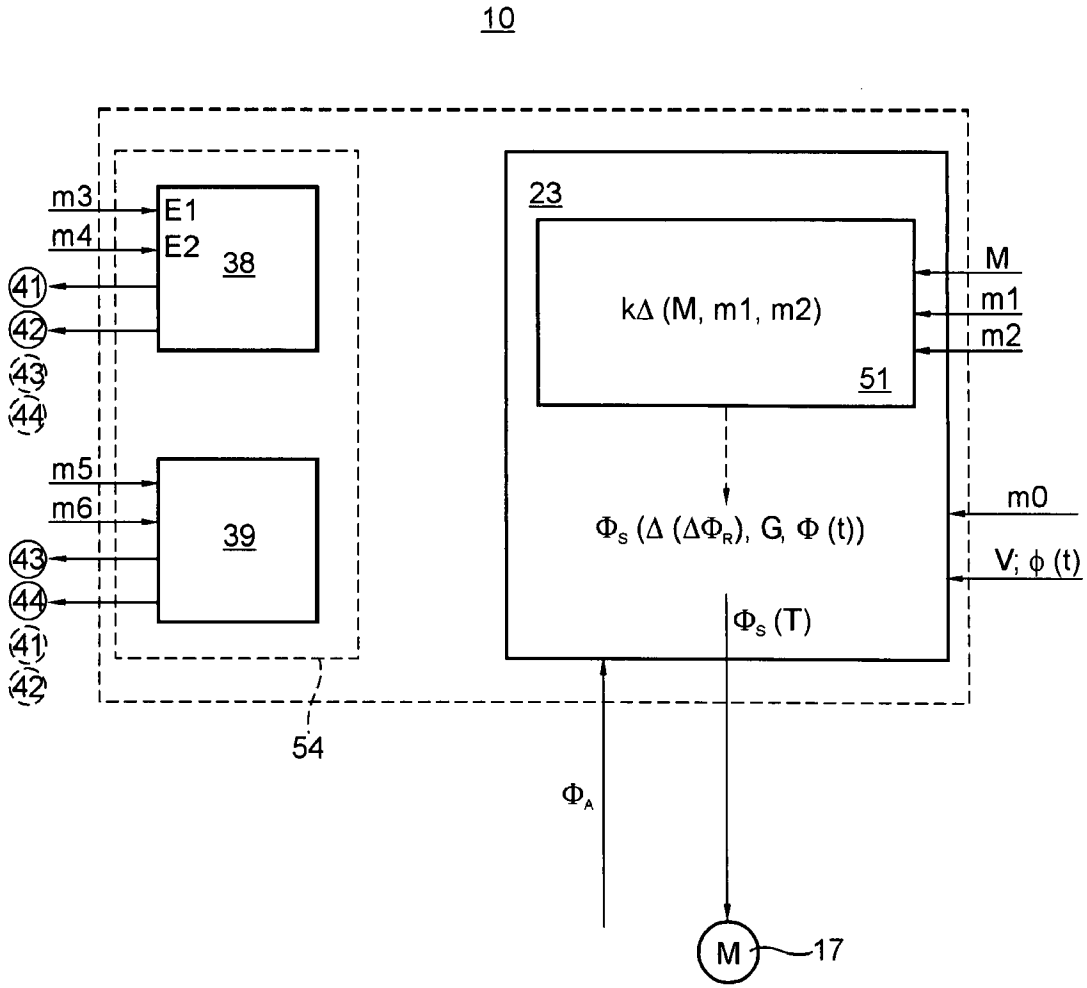
FIG. 6 a schematic illustration of a control device.

This target relative position $\Delta\Phi_R$ assigned to the drive motor 17 (optionally via the offset value Δ) could then be retained and stored in principle for a production sequence or even for general purposes. Advantageous, however, is a procedure specified in greater detail in what follows, according to which the target relative position $\Delta\Phi_R$ or the offset value Δ that contains this—and therefore the folding time or the time and/or place of first contact between product 03 and folding blade 04 on the folding table 02—is varied selectively for the purpose of controlling the folding process. This can be accomplished, for example, by adding a corresponding positive or negative correction value kΔ in the control module 23 or the drive control mechanism 23, for example, by modifying the stored value for the target relative position $\Delta\Phi_R$ or the offset value Δ (as illustrated schematically in FIG. 6), or by applying an appropriate correction value kΦ to the target angular position $\Phi_S$ (T), generated for the time T by the control module 23 or the drive control mechanism 23 (not shown). As specified in greater detail below, the determination of a correction value of this type kΔ; kΦ can be carried out in a control module 51 (and optionally in only a software control process) directly from stored correlations with data M relating to the production process (e.g., production phase and/or speed and/or product thickness and/or print substrate used), for example, being read out from stored tables or functions. Preferably, determination can be carried out in a correspondingly embodied process module 51 using the above-described data M relating to the production process and related measured values from the folding process (e.g., phase positions and/or product positions). In FIG. 6, the process module 51 is represented as integrated into the control module 23 embodied, for example, as a drive control mechanism 23, however, it can also be embodied as a module that is integrated into another device or is stand-alone, but is linked for the purpose of signals transmission to the control module 23 or to the angular signal supplied by the control module 23 to the drive motor 17. Ultimately, therefore, the target angular position $\Phi_S(T)$ in the correspondingly embodied control system 10 is preferably formed from the guide axis angular position $\Phi(t)$ using an optionally required transmission factor G and an offset value $\Delta$, wherein the latter is either itself varied using a predefined variable for the relative position $\Delta\Phi_R$, which can be modified using correction values $k\Delta$; $k\Phi$, or the adjustable predefined variable for the relative position $\Delta\Phi_R$ is taken into consideration separately in some other way in the algorithm for determining the target angular position $\Phi_S(T)$. As indicated in FIG. 6, for example, at the time t=T: $\Phi_S(T)=\Phi_S(\Delta(\Delta_0, \Delta\Phi_R(k\Delta)), G, \Phi(t=T))$, wherein ultimately the overall effective offset value $\Delta$ contains an originally purely geometrically based offset value $\Delta_0$ and the required, and optionally corrected relative position $\Delta\Phi_R$.

In principle, this procedure can also be applied to a control of the drive based solely on a target value for velocity or speed, which is predetermined by the guide axis. In this case—which will not be specified in greater detail here—however, at least one reference angle signal per motor revolution and/or per folding blade cycle must be available for phase-angle adjustment. The relative phase position can then be varied by varying the predefined speed for a limited period of time using a corresponding offset or correction value $\Delta$; $k\Delta$; $k\Phi$.

The drive means 17 embodied as drive motor 17 is therefore embodied as a drive motor 17, for example, electric motor, which can be controlled at least with respect to its speed. In one advantageous development, it is embodied as a stepper motor or even preferably as a drive motor 17 that can be regulated with respect to its rotational angle position. The embodiment of the drive motor 17 as a drive motor 17 that can be controlled at least with respect to its speed or with respect to a relative position adjustment (defined steps), or preferably with respect to an absolute angular position, is particularly advantageous in terms of the procedure(s) described below for adjusting and/or varying the synchronization of folding blade movement in terms of product position and/or changing operating parameters (e.g., machine speed, machine acceleration, product properties, etc.).

In an alternative but less preferable embodiment, the drive of the folding blade 03 could be mechanically coupled to the conveyance and/or production devices situated upstream (see above), wherein, however, a relative speed and/or relative phase position to the units upstream is embodied as adjustable and controllable, for example, via a remotely controlled transmission, which can be varied steplessly in terms of transmission factor and is located in the drive branch to the drive of the blade 04. In this case, the description below relating to the correction of phase position (and/or speed) applies, with the provision that rather than a drive motor for the blade 04, the transmission is appropriately actuated so as to adjust and/or modify a relative speed and/or a relative phase position between machine and blade phase position. In this case, the electronic guide axis described above would be dispensed with, and its function would be provided by the mechanical drive connection.

In one advantageous embodiment of the described procedure, specifically the sensor S0 can be provided upstream of the folding gap 06 in the direction of transport T1, for example, which sensor is connected to the control system 10, and on the basis of the product feed-through signals therefrom, the described basic triggering of the folding blade drive is carried out. In a modification thereof, however, an appropriate signal could also be applied to one of the stated sensors and/or measuring sites or measuring points S1 to S4, S7 or S8, particularly S3 and/or S4, if applicable, for further processing of said signal in a manner described in relation to the sensor S0. This is then carried out as described, for example, by comparing the phase position of the products 03 passing through and/or entering at the sensor S0 or at the alternatively used sensor, for example, S3, with the phase position of the folding blade drive, for example, taking into consideration a specific machine speed and/or guide axis position or guide axis speed. In this case, the relative position of these phases is constantly checked and compared with the target relative position $\Delta\Phi_R$. The processes for controlling folding time, which are above the other processes (described below), can then be taken into consideration as the correction value $k\Delta$; $k\Phi$ with respect to the target relative position $\Delta\Phi_R$.

The described adjustment and triggering of the phase position of the folding blade 04 to the flow of product is preferably supplemented by one or more of the methods described below.

In what follows, measures for ensuring the most problem-free operation and the most accurate folding possible are described, which are advantageous by themselves, but are particularly advantageous in a combination of several of said measures. The measures relate to corresponding embodiments of the longitudinal folding apparatus 01 and to procedures for operating the folding apparatus 01.

In one advantageous embodiment of the folding apparatus 01, an ideal folding time and/or an ideal folding location are ensured, despite varying production speeds V and/or different products 03 (thickness, material), by a device and a process for controlling the folding time, described in what follows.

For this purpose, at least one first and one second sensor S1; S2 (or measuring site S1; S2) which detect the presence of the product 03 in the relevant detection region (measuring site) on the folding table 02 are provided, which are spaced from one another, viewed in the direction of transport T1. At each of the outputs thereof, for example, a differentiation can be made between the presence and absence of the product 03 at the measuring site S1; S2 monitored by the relevant sensor S1; S2, and a corresponding signal m1; m2 or measuring signal m1; m2 can be read, for example, digitally in the form of a "1" or a "0", or in the form of a signal with dual analysis, at least in terms of "yes" or "no". The two sensors 51; S2 or measuring sites S1; S2 to be analyzed are spaced significantly from one another in the direction of transport T1, but are preferably adjacent to one another, viewed in the direction of transport T1, i.e., no additional measuring sites are required between these. Preferably, therefore, they do not need to be measuring sites S1; S2 that provide spatial resolution, as compared with photodiode arrays, line cameras or surface cameras, and instead preferably represent singular measuring sites S1; S2 spaced from one another. They delimit a so-called "capture area", the boundaries of which they monitor. For the process intended and described here, they have no use within the framework, for example, of distance measurements from a stop or a velocity measurement.

A first sensor S1 is provided directly at or immediately upstream of the surface of the stop device 09 which acts as the stop surface, or is at least disposed in such a way that it will detect the presence of the product 03 on the folding table 02 at a measuring site S1 directly at or immediately upstream of the stop surface. In this case, sensor S1 and/or the measuring site S1 thereof are spaced not at all, or, for example, at most 10 mm, preferably at most 5 mm, upstream of the surface of the stop device 09 that acts as the stop surface. At the same time, the sensor S1 and/or the measuring site S1 thereof are preferably disposed as close as possible, for example, at most at a distance a1 of 100 mm, advantageously at most 50 mm, preferably at most 15 mm, transversely to the direction of transport T1, from a plane E that passes through the longitudinal direction of the folding blade 04, preferably extending substantially vertically.

Preferably, a second sensor S2 is provided, which, or the measuring site S2 of which, viewed in the direction of transport T1, is spaced, for example, at least 3 mm, but at most by a distance a1,2 of 20 mm, advantageously at most by 10 mm, preferably by 3 mm to 8 mm, from the stop surface of the stop device 09 or from the first sensor S1 and/or, viewed transversely to the direction of transport T1, for example, by a distance a2 of at most 50 mm, advantageously at most 20 mm, preferably at most 10 mm, from the plane E, or, if sensor S1 is provided, from sensor S1 and/or the measuring site S1 thereof.

In one embodiment of the operation of the longitudinal folding apparatus 01, the products 03 to be folded are held with the leading end thereof, for example, in a so-called "capture area" between sensor S1 and sensor S2. In this case, the following ruling principle applies: Sensor S1 should not/cannot "see", i.e., the product 03 to be folded should not be detected at the measuring site 51 of the first sensor S1, and sensor S2 should see, i.e., each product 03 to be folded should be detected, at least briefly, at the measuring site S2 of the second sensor S2, before or at least during folding. This position is achieved by the time offset of the contact between folding blade 04 and product 03, and is maintained during this operating mode. This is accomplished in that the time and/or location of contact relative to the product 03 to be folded ("folding time"), i.e., the relative phase position $\Delta\Phi$ between product intake and folding blade phase position is selectively adjusted. In the above-described embodiment of the folding blade drive, this is accomplished, for example, in that a positive or negative correction value $k\Delta 1$ (or $k\Phi 1$), depending on the direction of the necessary change, acts on the drive, particularly the drive motor 17, in the calculation of the target angular position $\Phi_s(T)$. This is accomplished, for example, $b_y$, a defined, relative rotation of the cam disk 13, which is driven independently of transport devices, such as belts, disposed upstream of the folding table 02 or assigned thereto, via the drive motor 17, in that an appropriate correction value $k\Delta$; $(k\Phi)$ is applied to the above-described target relative position $\Delta\Phi_R$ or the offset value $\Delta$ that contains or represents this.

Figure 7:
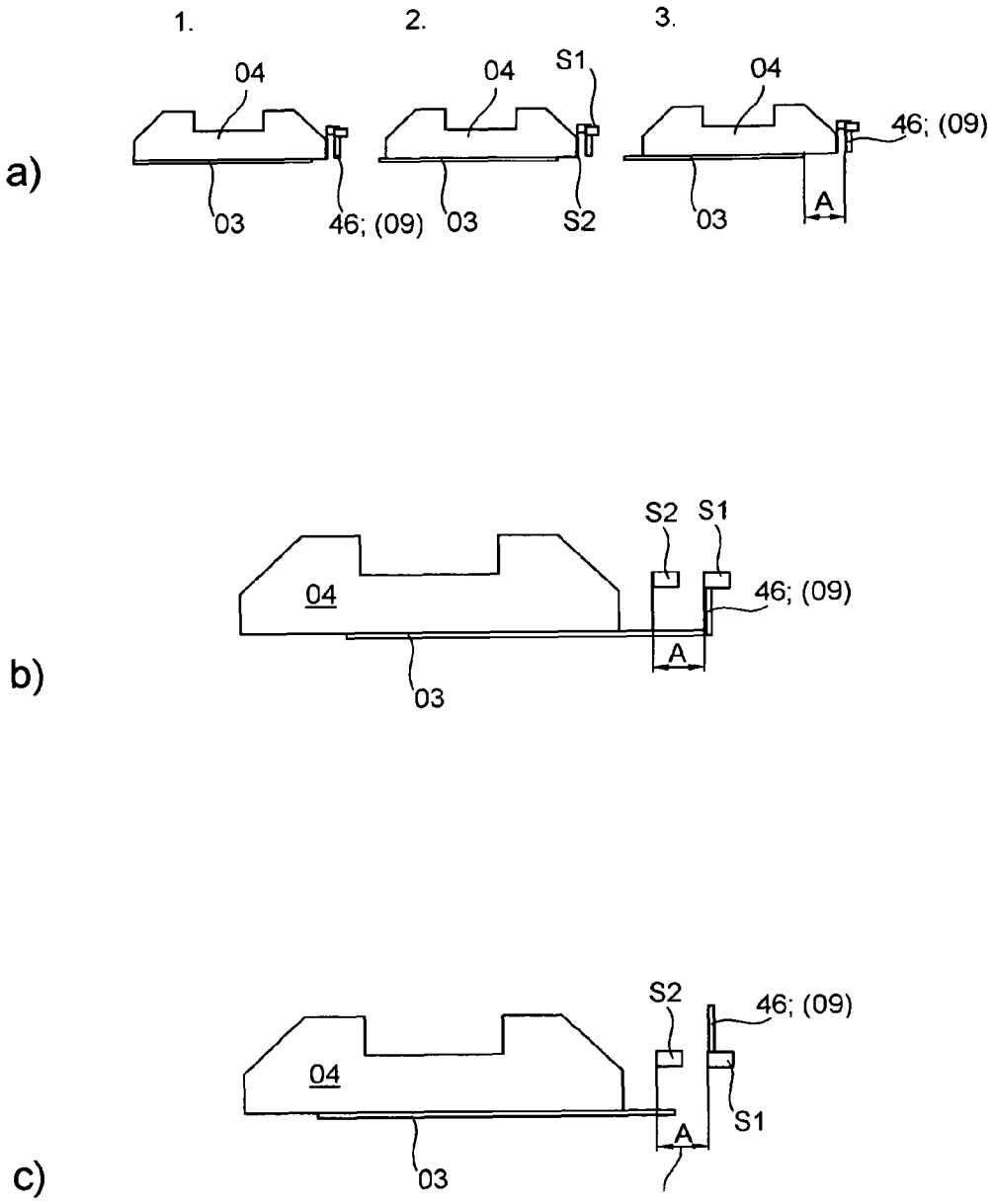
FIG. 7 schematic illustrations of control stages or operating modes of the longitudinal folding apparatus a), b) and c)

One advantageous embodiment of a stepped control of the folding time for the longitudinal fold (e.g., also called the third fold or second longitudinal fold) involving a partial or full use of the above-described devices is described in what follows and detailed in reference to FIG. 7:

In the customary mode of operation, as press speed increases, the products 03 are driven with increasing force against the stop 46; (09), and beyond a critical speed V, which is also dependent on the condition of the product 03, for example, said products become damaged.

Automatic run-up (particularly synchronously with the web-fed rotary printing press upstream, for example, via the electronic guide axis) is subdivided into several, for example, four, operating modes or stages.

A first operating mode (stage), for example, represents an acceleration phase of the machine. In this stage, the production speed V, and associated therewith, the frequency of the incoming products 03, is increased along a predefined curve or slope, for example. To counteract the above-described damages, during the acceleration phase, for example, generally or below a lower threshold speed V1 of the production speed V, for example, below V1=5,000 copies/hour, the movement of the folding blade 04 is controlled in such a way that contact of the product with the folding blade 04 occurs successively earlier. During this first phase, the point of contact of the folding blade 04 with the product 03 is regulated successively and deliberately away from the stop 46; (09), i.e., a distance A between product 03 and stop 46; (09) at the time when the folding blade 04 touches the product 03 (first contact) is successively and deliberately increased. This is carried out recurrently as soon as the sensor S1, for example, photo sensor S1, detects a product leading edge at or directly upstream of the stop 46; (09) (see above). As a result, the products 03 are slowed under the folding blade 04, without contacting the stop 46; (09) or at least without striking the stop 46; (09) with significant speed V. In this, for different production speeds V, a later time of first contact for a lower production speed V and an earlier time of first contact for a higher production speed V are controlled such that contact does not occur, or, in any case, contact with the stop 46; (09) occurs without significant speed, i.e., a speed of essentially 0 m/s, for example, lower than 0.3 m/s, particularly lower than 0.1 m/s.

This process is illustrated by way of example for three different speeds V achieved successively during acceleration, in ascending order in diagrams 1., 2. and 3. of FIG. 7*a*). As is clear from these diagrams, as the speed V increases, the product 03 is moved further from the stop 46; (09). In this case, as the speed V increases (diagrams 1., 2., 3.), the folding drive or drive motor 17 is actuated such that contact occurs successively earlier relative to the position of the product 03 on the folding table 02. This is accomplished, for example, in that, as soon as the sensor S1, for example, photo sensor S1, detects a product leading edge at or directly upstream of the stop 46; (09) (see above), a correction value $k\Delta 2$; $(k\Phi 2)$ is applied to the above-described target relative position $\Delta\Phi_R$ or the offset value $\Delta$ that contains this. With the next detection, the correction value $k\Delta 2$; $(k\Phi 2)$ is applied again to the previously modified target relative position $\Delta\Phi_R$ or the modified offset value $\Delta$ that contains this. This correction value $k\Delta 2$; $(k\Phi 2)$ can be stored, and preferably modified, in a memory, for example, in a memory of the control system 10, the control module 51 or a machine control system.

A second advantageous operating mode (e.g., a second stage of a production cycle) (FIG. 7*b*)) describes, for example, a constant production speed V, which can lie, for example, below a specific second threshold speed V2, for example, V2<45,000 copies/hour. As soon as the machine has reached this production speed (e.g., V2) and the sensor S1 detects no product 03 at the stop 46; (09), the time of use of the folding blade 04 is controlled toward the stop 46; (09), i.e., for example, the folding blade drive is decelerated (correction of the existing target relative position $\Delta\Phi_R$). Again, this is accomplished by a successive application of a correction value $k\Delta 3$; $(k\Phi 3)$, in this case a negative value, for example, to the current target relative position $\Delta\Phi_R$. When the sensor S1 again detects the product leading edge at the stop 46; (09), the value for the correction angle $\Delta$ or for the target relative position $\Delta\Phi_R$ existing at that time is maintained for the further driving of the drive motor 17. In this operating mode, the product 03 either has not yet come into contact with the stop 46; (09) or has done so at least without significant speed, i.e., at a speed of essentially 0 m/s, for example, less than 0.3 m/s, particularly less than 0.1 m/s. Advantageously, an additional manual correction of the folding blade position toward or away from the stop 46; (09), i.e., a manual adjustment of the retained target relative position $\Delta\Phi_R$, can be carried out. At a constant production speed V, for example, less than V2, the product 03 is therefore positioned at or in the immediate vicinity of the stop 46; (09), and is folded. The product 03 then has no or only slight contact with the stop 46; (09).

In a second operating mode representing an alternative to the second operating mode, or in a third operating mode (e.g., a third stage of a production cycle) (FIG. 7*c*)), the production speed V is again constant, and can, for example, be higher than the above-described threshold speed V2, for example, at least a threshold speed V3, for example, V3>=45,000 copies/hour. In this case, the stop 46; (09) can be disengaged pneumatically, for example. The folding position is monitored by the sensor S1 at or directly upstream of the stop 46; (09), and by the second sensor S2, which is disposed, for example, approximately 5 mm upstream of the stop 46; (09). If the sensor S1 detects a product leading edge at the stop 46; (09), the contact point of the folding blade 04 is controlled away from the stop 46; (09) by applying a correction value kΔ3; (kΦ3) to the target relative position $\Delta\Phi_R$ on the basis of the signals from the sensor S1, for example, i.e., the time of first contact is moved forward. If the sensor S2 disposed upstream of the first sensor S1, viewed in the direction of transport T1, no longer detects any more products 03 over a specific window of time ΔT1, which can be dependent on the product flow (speed), for example, the contact point is regulated back toward the stop 46; (09), in other words, the relative angular position of the drive, for example, is regulated back in the other direction. This is accomplished using a correction value kΔ4; (kΦ4) that acts in the opposite direction. Therefore, at production speeds V of at least V2, the product 03 is positioned and folded with its leading edge between the sensors S1 and S2. The stop 46; (09) can be adjusted toward or preferably away from the product.

A further, for example, fourth operating mode (or stage), not shown, describes the deceleration of the machine, i.e., an operating mode with negative acceleration. With deceleration, the products 03 tend to be held back, because the energy for driving the product 03 forward is constantly decreased. Consequently, in this operating mode, the contact point is controlled toward the stop 46; (09), i.e., for example, the target relative position $\Delta\Phi_R$ is appropriately corrected toward the "back", i.e., a correction value kΔ5; (kΦ5) is applied to it, which decelerates the folding blade drive, for example. This is carried out, for example, as soon as the sensor S2 no longer detects any product 03 upstream of the stop 09; (46) over a specific window of time ΔT2 (e.g., greater than 5 s). If the production speed V drops below a threshold speed V2, for example, V2<45,000 copies/hour, during deceleration, for example, an operating mode that is comparable to the first operating mode but has an inverse sign with respect to the correction value can be used, wherein in this case again the sensor S1 is analyzed, but the product edge is controlled by a successive modification of the target relative position $\Delta\Phi_R$ in such a way that the modification is carried out when product 03 is no longer detected at the sensor S1 over a window of time T3. In this operating mode, the product 03 is positioned directly upstream of or at the stop 46; (09).

For implementation in this case, the signals m1; m2 of the sensor S1, which detects the time of arrival and monitors the products 03 at the stop 46; (09), and of the second sensor S2, which monitors the products 03 shortly upstream of the first sensor S1 and upstream of the stop 46; (09), can be sent, for example, to a digital input of a controller, for example, of a control loop of the drive control mechanism 23 or of the above-described process module 51. The signals m2 of the second sensor S2 and the signals m1 of the first sensor S1 are detected, for example, via a measuring tracer function of the control apparatus at two measuring tracers.

The measuring tracer function for measuring tracers 1 and 2 is input, for example, via an integrated SPS of the drive control mechanism 23, and is carried out, for example, when the drive control mechanism 23 has reached the operating mode.

Figure 10:
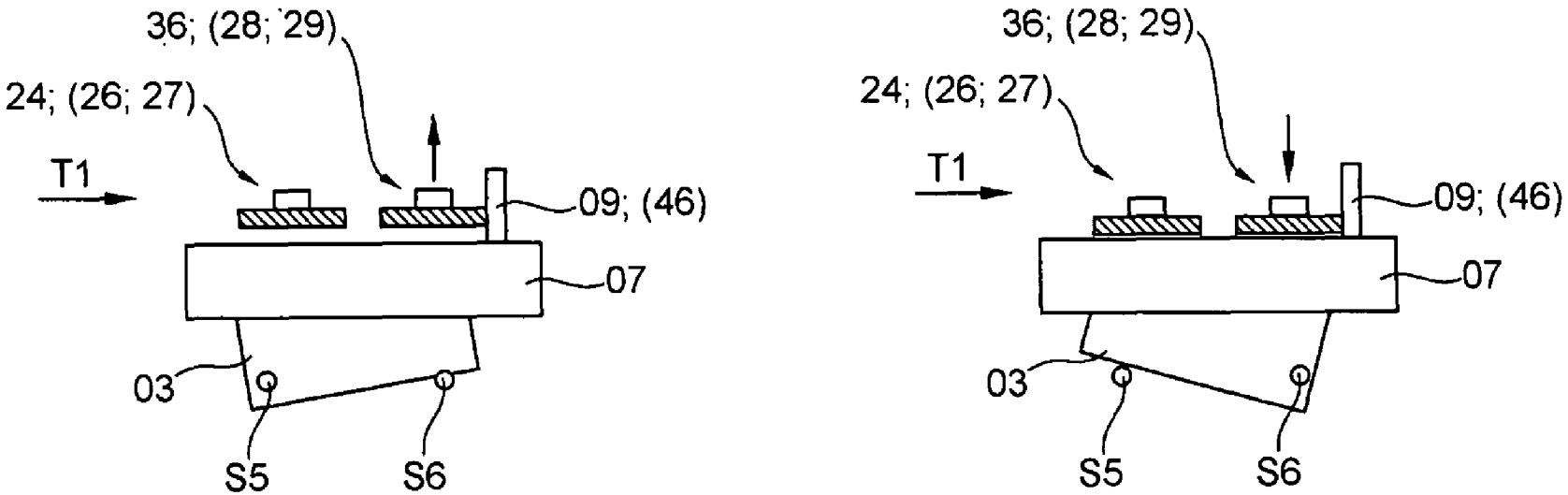
FIG. 10 a schematic illustration of a procedure for correcting a skewed position.
Figure 11:
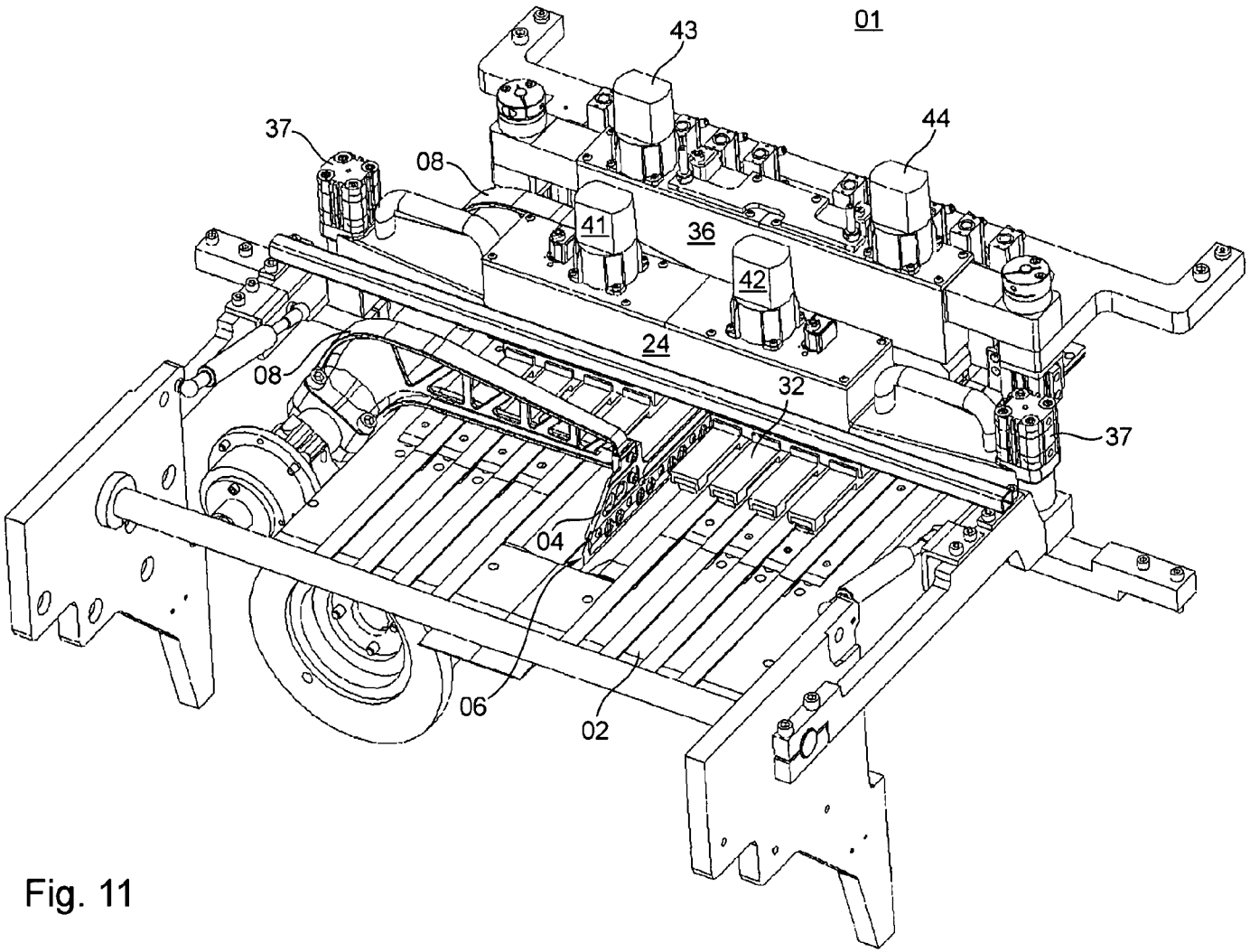
FIG. 11 a perspective illustration of an advantageous embodiment of the longitudinal folding apparatus.

Preferably, the longitudinal folding apparatus 01, particularly advantageously in conjunction with one or more of the above-described embodiments, also has one or more devices and/or procedures for monitoring and correcting a skewed position of the product 03 to be folded longitudinally, which is resting on the folding table 02, and/or a skewed position of a longitudinally folded product 03 that is leaving the folding rollers 07 (FIGS. 5 and 10).

For correcting a skewed position of the product 03 to be folded longitudinally, which is resting on the folding table 02, at least one braking device 24; 36 is provided in the longitudinal folding apparatus 01 above the folding table 02, which device has at least two braking elements 31; 32; 33; 34 or groups 26; 27; 28; 29 of braking elements 31; 32; 33; 34, spaced from one another transversely to the direction of transport T1, and particularly disposed on both sides of the folding gap 06, which in an advantageous embodiment are embodied, for example, as brushes 31; 32; 33; 34 or groups of brushes 26; 27; 28; 29. These allow a product 03 to be decelerated as it passes through said brushes, particularly via friction.

In this case, if the device and procedure described below for correcting a skewed position of the longitudinally folded product 03 leaving the folding rollers 07 are also used, one or more of the braking elements 31; 32; 33; 34 or groups 26; 27; 28; 29 of braking elements 31; 32; 33; 34 provided for correcting the skewed position of the product on the folding table 02 can be used for both purposes.

Preferably, at least two braking elements 31; 32 or groups 26; 27 of braking elements 31; 32, disposed on the two sides of the folding gap 06, can be adjusted independently of one another with respect to the distance thereof from the folding table 02 or the upper side of the folding table and/or from the product 03. In the case of two braking devices 24; 36 spaced in the direction of transport T1, braking elements 31; 32 or groups 26; 27 in a braking device 24 that is closer to the intake side are preferably used for the above-described correction of skewed positioning on the folding table 02.

The braking elements 31; 32; 33; 34 or groups 26; 27; 28; 29 of braking elements 31; 32; 33; 34, embodied as adjustable independently of one another with respect to their distance from the folding table 02, have actuators 41; 42; 43; 44, for example, drives 41; 42; 43; 44, which are preferably actuable independently of one another.

Independently of the above-described sensors S1 and S2, but particularly advantageously in conjunction with these, two sensors S3 and S4 (or measuring site S3; S4) that detect the presence of the product 03 on the folding table 02 are provided (see FIG. 3), which, or the measuring points S3; S4 of which, are spaced from one another, viewed transversely to the direction of transport T1, by a distance a3,4, for example, of at least 100 mm, advantageously at least 150 mm, preferably 150 mm to 250 mm. The two sensors S3 and S4, or the measuring points S3; S4 thereof, are preferably disposed one on each side of a plane E that extends in the longitudinal direction of the folding blade 04, particularly approximately equidistant from this plane E (i.e., up to ±10 mm deviation). They or the measuring points S3; S4 thereof are preferably disposed in the same alignment which extends perpendicular to the direction of transport T1 and/or perpendicular to the plane E. In addition, they can advantageously be disposed at essentially the same vertical distance a03, particularly a03 of 3 mm to 10 mm, from a product 03 resting on the folding table 02, between folding table 02 and sensor S3 or S4.

The two sensors S3; S4 and/or measuring points S3; S4 are preferably disposed at a distance all, viewed in the direction of transport T1, from the position of the stop surface when the stop device 09; (46) is in the active status, which distance is at least 20 mm, advantageously at least 30 mm, preferably between 30 mm and 200 mm, more particularly, approximately 40 mm. Advantageously, however, they are disposed, viewed in the direction of transport T1, in the region of the folding table 02, i.e., between the intake region of the intake side 18 and the stop device 09 at the above-described distance.

Preferably, the two sensors S3; S4 and/or measuring points S3; S4, viewed in the direction of transport T1, are disposed at a level in the region of the insertion length of the folding blade 04, particularly at the level of a braking device 36; 24, i.e., for example, intersecting with the insertion length or with a length L33 of braking elements 31; 32; 33; 34, viewed transversely to the direction of transport T1.

In the method for detecting a skewed position of a product 03 entering on the folding table 02, the sensors S3 and S4 and/or the analysis means thereof detect a time offset as the leading product edge passes through. If a deviation Δt1 of the time offset from a target time offset is present, for example, for multiple products 03 in succession, the drive 41 to 44, for example, drive 41 or 42, of the side on which the product edge is detected as first begins to control "its" brush group 26; 27; 28; 29 or brushes 31; 32; 33; 34, particularly brushes 31 or 32, downward. By applying greater brush pressure to one side of the product, that side is held back with greater force than the other side, and is therefore rotated slightly. If the modified braking effect then results in a shifted folding time, the above-described control of the folding time is again initiated, for example, and the necessary folding time is regulated via the control loop so as to maintain the target relative position $\Delta\Phi_R$ by means of the product phase position detected by the sensor S0 and the angular position of the drive motor 17 or drive. However, in each case preferably only one system is controlled, and then measured, and only then is further action initiated. Conversely, the drive 41 to 44, for example, drive 41 or 42, of the side on which the product edge is detected as second could also control "its" brush group 26; 27; 28; 29 or brushes 31; 32; 33; 34, particularly brushes 31 or 32, upward. When lower brush pressure is applied to one side of the product, this side is held back with less force than the other side, and the product 03 is again rotated slightly. The folding time is corrected if necessary as described above.

Signals m3 and m4 of the sensors S3 and S4 are processed, for example, via appropriate means in a control module 38 (optionally only one software control process 38), or module 38, which can also be embodied, for example, as a component of the control system 10 (as shown) or as separate. Signals m3 and m4 of the sensors S3 and S4 are fed to this module 38, these signals m3 and m4 are analyzed, and a result in the form of a control signal is fed to one or more of the drives 41; 42; 43; 44, particularly drive 41 and/or 42.

Figure 8:
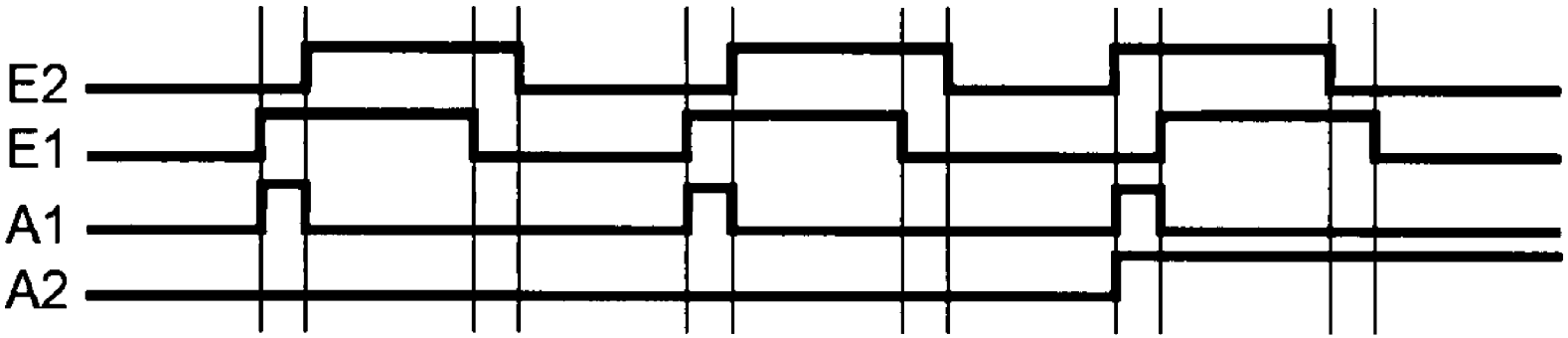
FIG. 8 an example of a signal cycle for the trigger module of two sensor signals.

The principle of skewed position recognition is implemented, for example, by means of a trigger module. The module 38 has, for example, two signal inputs, for example, inputs E1; E2, one pulse output A1, and one directional output A2. The sensor S3 for detection on a first side of the folding apparatus 01 is input at the input E1, for example, and the sensor S4 for the second side is input at the input E2. The pulse output A1 is set when input E1 (e.g., by signal m3) or input E2 (e.g., by signal m4) supplies a first signal. The pulse output A1 is reset when the other of the two inputs E2; E1 (e.g., by signal m4 or m3) subsequently supplies a signal. The directional output A2 supplies a signal, for example, when input E2 (e.g., by signal m4) has been set before input E1 in time (e.g., by signal m3). In the opposite case, no signal is supplied. FIG. 8 shows an example of a signal cycle for the trigger module.

The pulse length of pulse output A1 preferably serves as a measure for the detected product skew. The directional output A2 indicates the side on which the product 03 was first detected. When the pulse output A1 supplies a signal, this is read in via a time measuring function of the measuring tracer function of the module 38, and is ultimately analyzed in a logic program. The time measuring function supplies a time unit in microseconds, for example. This time is converted in the logic program to a specification in 1/100 millimeter, for example, taking into consideration the time required by a product 03 per mm of path as a function of machine speed.

From the information regarding the direction of the skewed position (directional output A2) and the converted measurement of skew (pulse output A1), a correspondingly dimensioned control signal is then sent to the control element that is to be addressed, i.e., one of drives 41 to 44, particularly one of drives 41 or 42 of brushes 31; 32.

To correct a skewed position of the longitudinally folded product 03 leaving the folding rollers 07, preferably at least two braking devices 24; 36, spaced from one another in the direction of transport T1, specifically one braking device 24; 36 closer to the intake side and one braking device farther from the intake side, are preferably provided in the longitudinal folding apparatus 01 above the folding table 02, and are capable of decelerating a product 03 as it passes through when they are in a suitable contact position, particularly via friction. Each braking device 24; 36 has at least one braking element 31; 32; 33; 34 or at least one group 26; 27; 28; 29 of braking elements 31; 32; 33; 34, which in one advantageous embodiment is or are embodied as brushes 31; 32; 33; 34, for example.

Preferably, at least one of the braking devices 24; 36 is adjustable independently of the other of the braking devices 24; 36 in the distance thereof from the folding table 02. In this, the braking device 24 closer to the intake side can be adjusted in the distance thereof from the folding table 02, for example, a maximum of 50 mm, and/or can alternatively be brought into or out of contact with the product flow passing through, by means of at least one actuator 37, preferably at least one pressure-actuable actuator 37, embodied, for example, as a pneumatic or hydraulic cylinder (FIGS. 11 to 15).

In this case, if the above-described device and procedure for correcting a skewed position on the folding table 02 are also used, one or more of the braking elements 31; 32, or at least one group 26; 27 of braking elements 31; 32, provided for correcting the skewed position of the product 03 leaving the folding rollers 07, particularly one or more of the braking elements closer to the intake side, can be used for both purposes.

Figure 12:
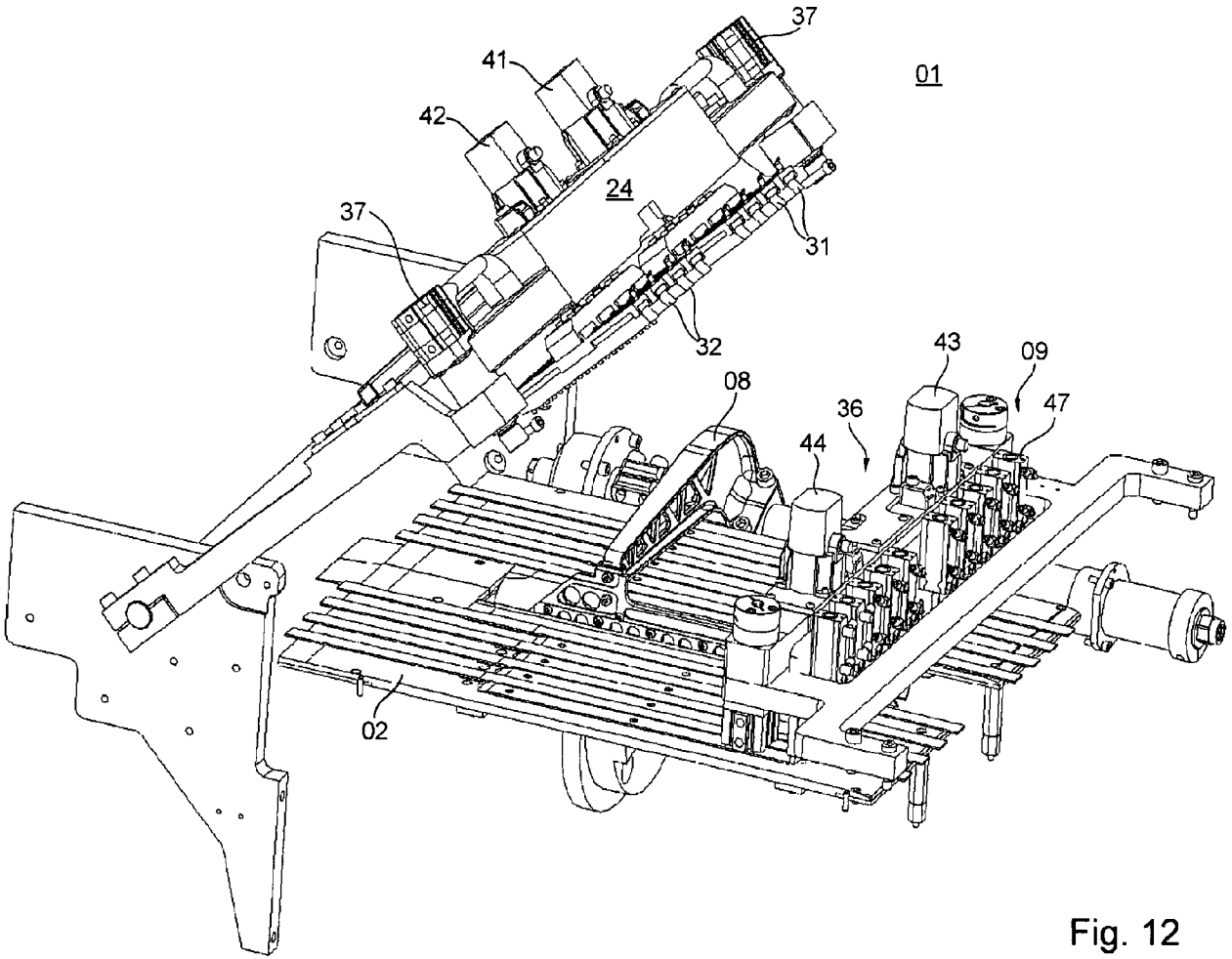
FIG. 12 a perspective illustration of the embodiment of the longitudinal folding apparatus of FIG. 11 with the braking device pivoted outward.
Figure 13:
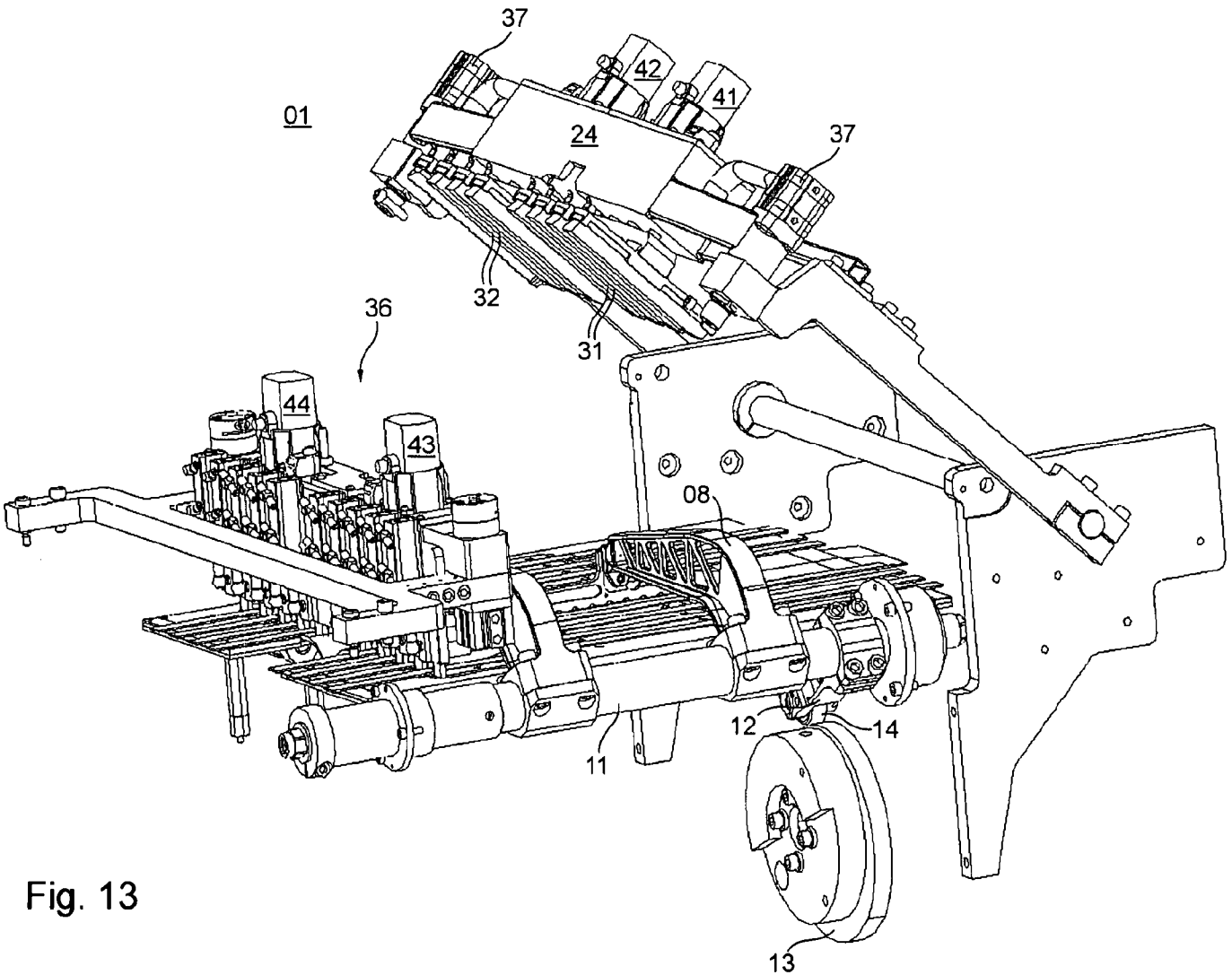
FIG. 13 an illustration according to FIG. 12 from a different perspective.
Figure 14:
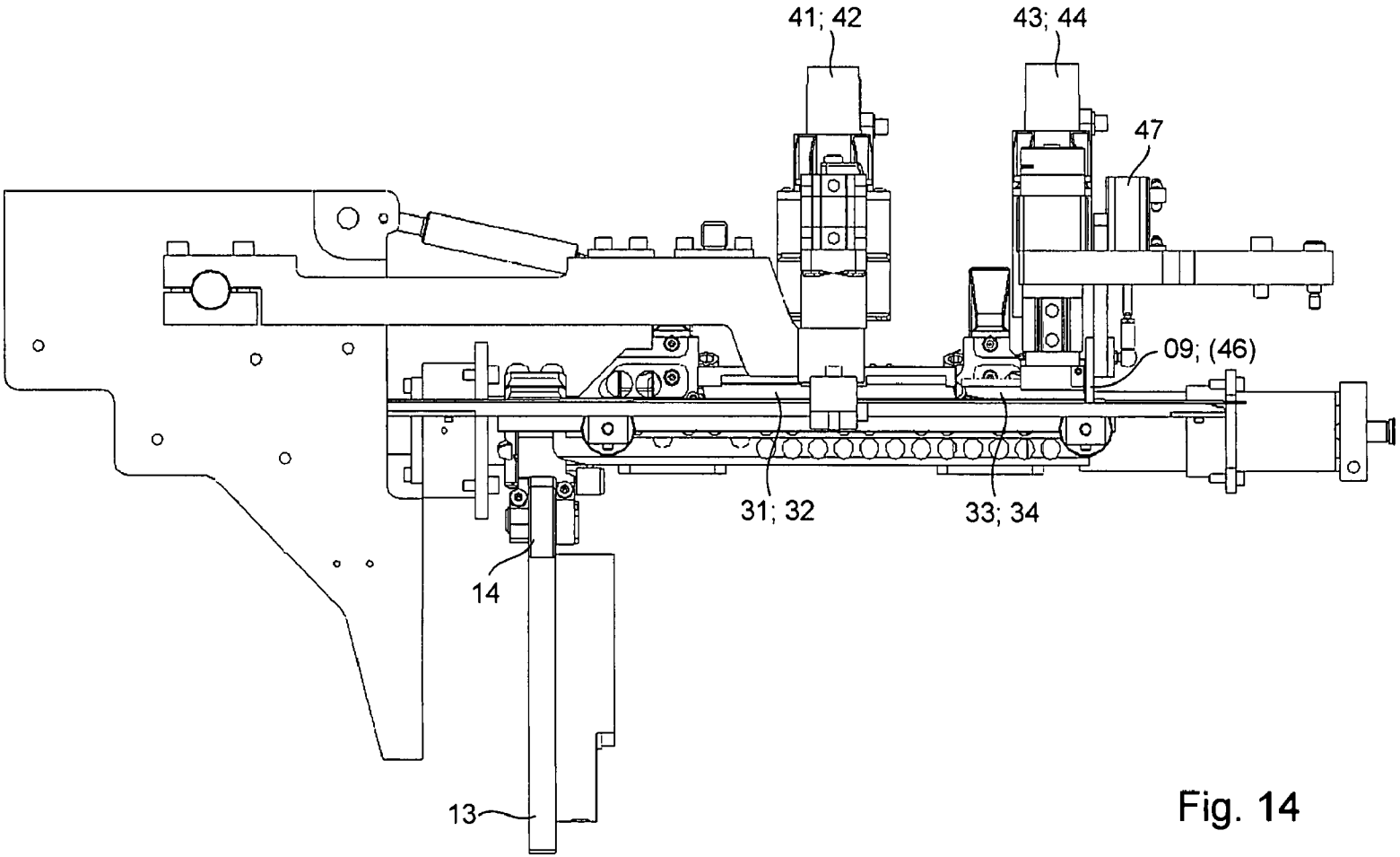
FIG. 14 a longitudinal section of the embodiment of the longitudinal folding apparatus of FIG. 11.
Figure 15:
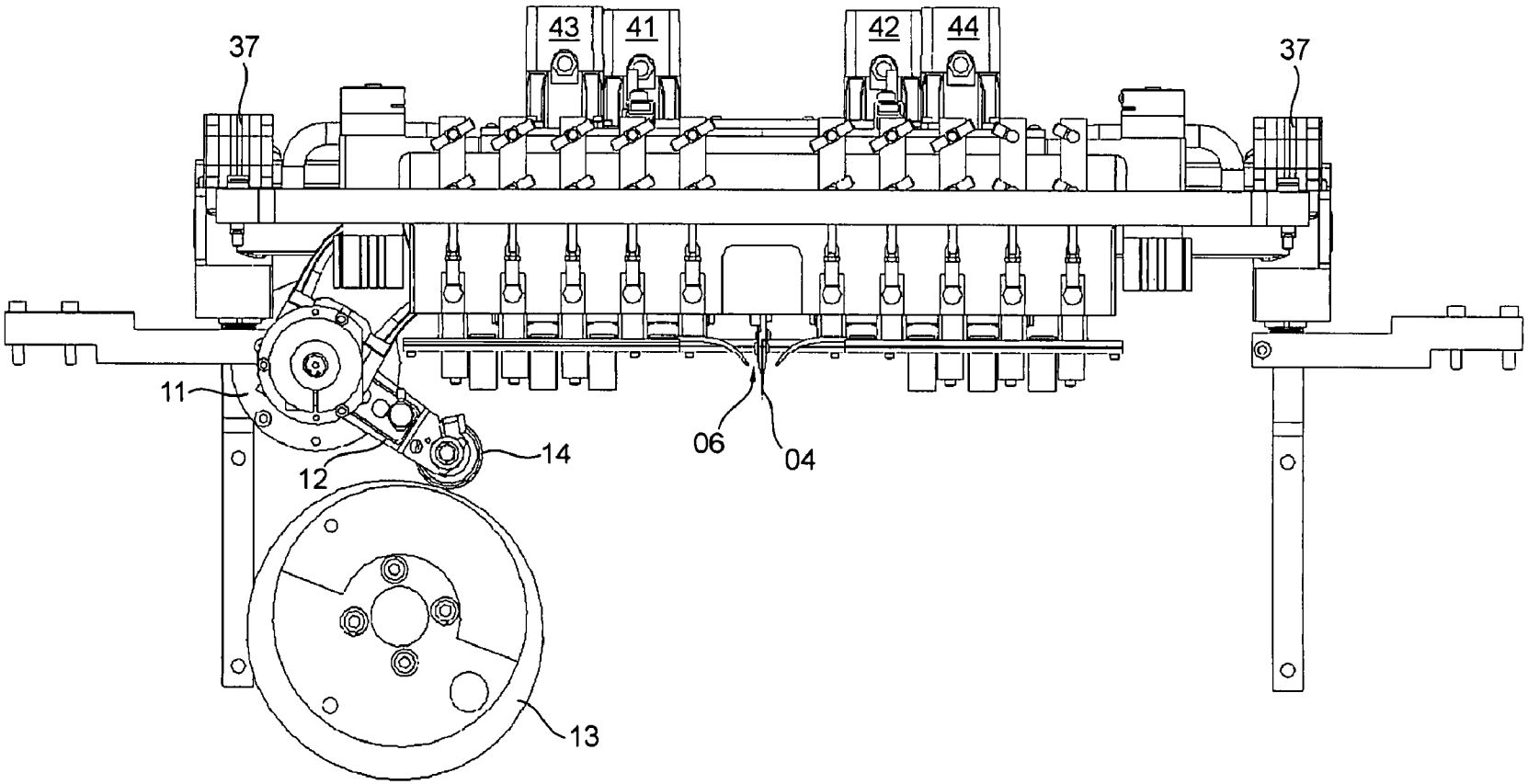
FIG. 15 a cross-section of the embodiment of the longitudinal folding apparatus of FIG. 11.

The entire braking device 24 closer to the intake side can be disposed so as to be pivotable outward, away from an active area of the folding table 02, for example, more than 200 mm away from the folding table 02 (FIGS. 12 and 13).

At least one of the at least two braking devices 24; 36, preferably both braking devices 24; 36, have at least two braking elements 31; 32; 33; 34, for example, brushes 31; 32; 33; 34, or "stop brushes" 33; 34 farther from the intake side and "center brushes" 31; 32 closer to the intake side, or at least two groups 26; 27; 28; 29 of braking elements 31; 32; 33; 34, for example, brush groups 26; 27; 28; 29 or brush systems 26; 27; 28; 29.

The braking elements 31; 32; 33; 34 or groups 26; 27; 28; 29 of braking elements 31; 32; 33; 34, embodied as adjustable independently of one another with respect to their distance from the folding table 02, preferably have actuators 41; 42; 43; 44 that can be actuated independently of one another.

Preferably, particularly in conjunction with the above-described devices for monitoring and correcting a skewed position of the product on the folding table 02, a total of at least four braking elements 31; 32; 33; 34, or at least four groups 26; 27; 28; 29, for example, two braking devices 24; 36, each with two groups 26; 27; 28; 29 of braking elements 31; 32 33; 34, are provided, wherein the four braking elements 31; 32; 33; 34 or four groups 26; 27; 28; 29 are each adjustable independently of one another with respect to their distance from the folding table 02, each by one actuator 41; 42; 43; 44. The first two groups 26; 27 have, for example, four braking elements 31; 32 each, for example, each having a length L31 in the direction of transport T1 of at least 100 mm, for example, preferably at least 150 mm, particularly approximately 200 mm, and the two second groups 27; 28 have, for example, three braking elements 33; 34 each, for example, each having a length L33 in the direction of transport T1 of at least 50 mm, for example, preferably at least 70 mm, particularly approximately 90 mm.

At least one of the braking elements 31; 32; 33; 34 or groups 26; 27; 28; 29 that are closer to the intake side and one of those that are farther from the intake side are embodied as adjustable independently of one another in terms of their distance from the folding table 02 or from the product 03 disposed thereon, particularly via one actuator 41; 42; 43; 44 each.

The (respective) actuator 41; 42; 43; 44 is embodied, for example, as a motor, particularly as a servo motor or stepper motor, which preferably acts via a transmission, for example, a threaded drive, or in some other manner on the braking elements 31; 32; 33; 34 or groups 26; 27; 28; 29 to be adjusted, for the purpose of adjusting the distance thereof from the folding table 02.

Figure 9:
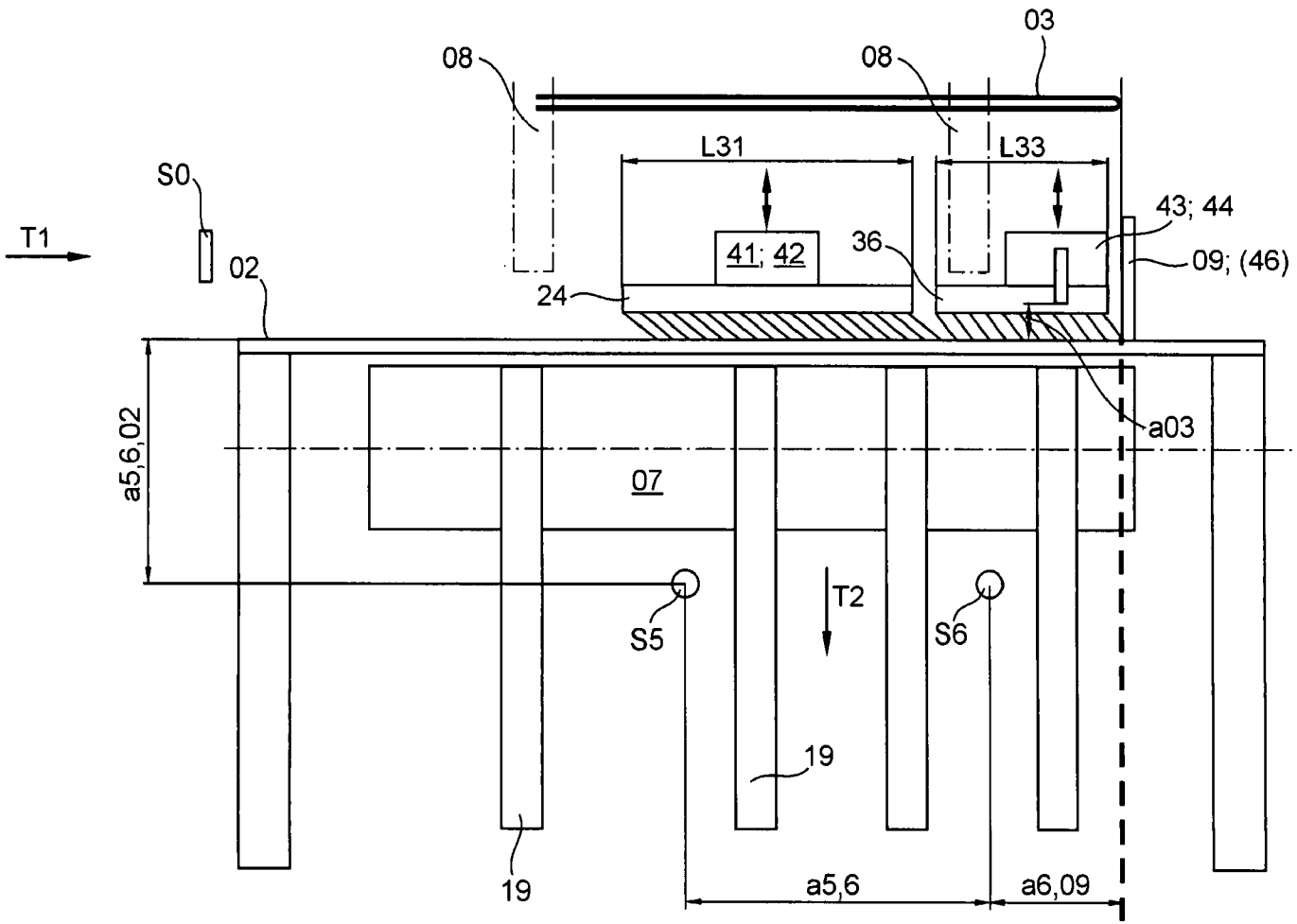
FIG. 9 a schematic longitudinal cross-section of the folding apparatus.

Independently of one or more of the sensors S0; S1; S2; S3; S4, but particularly advantageously in conjunction with some of these or with all of these, two sensors S5 and S6 (or measuring site S5; S6) that detect the presence of the product 03 that has been folded longitudinally after passing through the folding gap 06, particularly beneath the folding table 02, are provided, which, or the measuring points of which S5; S6 are spaced from one another, viewed in a direction parallel to the longitudinal direction of a folding roller 07 and/or to the longitudinal direction of the folding gap 06 and/or to the longitudinal direction of the folding blade 04, by a distance a5,6 of at least 80 mm, for example, advantageously at least 120 mm, preferably 120 mm to 180 mm (FIG. 9). The two sensors S5; S6 or measuring points S5; S6 are preferably disposed at essentially the same vertical distance a5,6,02 of 150 mm to 400 mm, for example, particularly a maximum of 350 mm, from a surface of the folding table 02, on the folding table 02, which supports the product 03 prior to folding, and/or particularly downstream of the folding rollers 07, viewed along the product path. One of the two sensors S6; S5 or measuring point(s) S6; S5 is disposed, for example, viewed in a direction parallel to the longitudinal direction of a folding roller 07 or to the longitudinal direction of the folding gap 06 or to the longitudinal direction of the folding blade 04, spaced at most by a distance a6,09 of, for example, 120 mm, particularly at most 100 mm, from a plane that passes through the stop surface of the stop 09; (46), and/or the other sensor S5 is spaced by a distance from this plane of at least 150 mm, particularly at least 200 mm. Preferably, the two sensors S5; S6 are located the same distance from the position of the product 03 being guided past.

As was described above, the braking element 31; 32; 33; 34 close to the intake side and the braking element remote from the intake side, or at least one group 26; 27; 28; 29 of these types of braking elements 31; 32; 33; 34, are used for straight folding, i.e., for correcting potentially skewed positions downstream of the folding gap 06. In this case, during production, the outlet of the folded product 03 is monitored underneath the folding table 02 by the sensors S5 and S6 or at the measuring sites S5 and S6 thereof. If the folded product 03 is guided out of the folding rollers 07 with its leading edge not parallel to the folding roller axes, for example, then at high speeds, folds can form or tears can occur on the outer edges of the product 03. This can be corrected by greater or less pressure being applied to the (or friction with the) product 03 by all or some braking elements 31; 32; 33; 34 (e.g., brushes 31; 32; 33; 34) or groups 26; 27; 28; 29 of braking elements 31; 32; 33; 34, for example, brush groups 26; 27; 28; 29 (FIG. 10). Greater brush pressure, for example, of the front brush groups 28; 29, i.e., farther from the intake side, would cause a stronger retention of the product end that is leading with respect to the direction of transport T1 as it passes through the folding rollers 07, and would therefore rotate the folded product 03 in one direction, and vice versa.

Signals m5 and m6 of sensors S5 and S6 are processed, for example, via appropriate means in a control or processing module 39, or module 39, which can also be embodied, for example, as a component of the control system 10 (as shown) or as separate.

Signals m5 and m6 from sensors S5 and S6 are fed to this module 39, these signals m5 and m6 are analyzed, and a result in the form of a control signal is fed to one or more of the drives 41; 42; 43; 44, particularly drive 43 and/or 44.

The analysis can preferably be implemented by means of a trigger module, in a manner similar to the manner described above in reference to m3 and m4. In this case, the above-described signals m3 and m4 are to be replaced by signals m5 and m6. From the information regarding the direction of the skewed position (e.g., again a directional output A2) and the converted measurement for skew (e.g., again a pulse output A1), an appropriately dimensioned control signal is then supplied to the control element or control elements (e.g., as drives with assigned brushes) to be addressed, i.e., to one or more of drives 41 to 44, in this case particularly drives 43 and/or 44 (or generally the "drive" of one braking device 36, particularly the braking device farther from the intake side).

Therefore, in the procedure for correcting a skewed position of a product 03 exiting the folding rollers 07, two sensors S5 and S6, spaced transversely to the direction of transport T2, detect a time offset Δt2, or a deviation Δt2 from a target time offset (e.g., zero seconds) as the leading product edge passes through. As a result of the deviation Δt2 or the time offset Δt2, with a plurality of products 03 following one another in succession, for example, one of two braking elements 31; 32; 33; 34 disposed on the folding table 02, spaced from one another in the direction of transport T1, or one of two groups 26; 27; 28; 29 of braking elements 31; 32; 33; 34 disposed on the folding table 02, spaced from one another in the direction of transport T1, is then moved closer to the product 03 or father away from the product 03. In principle, this can also be carried out by a sensor, which has a field of view that allows it to detect and analyze the passage of the leading or trailing edge at least two spaced measuring points (S5; S6).

The detection of an above-described skewed or angled position—on and underneath the folding table 02—is carried out in each case by means of two sensors, for example, sensor S3 and S4 or sensor S5 and S6, which are disposed parallel to one another in pairs (see above), and detect a product edge that extends transversely to the respective direction of transport T1; T2, particularly the leading edges of the products 03. Alternatively, however, they could also detect the trailing edges.

For skew compensation underneath the folding table 02, for example, the brushes 33, 34 remote from the intake side (also called "stop brushes" 33; 34) are pressed with sufficient force against the product 03. The brushes 31; 32 closer to the intake side (also called "center brushes" 31; 32) are used, for example, only for the above-described skew compensation on the folding table 02. Once the two center brushes 31; 32 (or groups 26; 27) provide a greater tension value than a truing value established in advance for production, for example, the center brushes 31; 32 are not lowered any further, and instead, in one advantageous embodiment, travel a definable distance away from the folding table 02, for example. This ensures that the center brushes 31; 32 never press too hard against the product 03.

If, despite a skew compensation that is controlled automatically in the above-described manner, the operator still detects skew in the product 03, a further development is advantageous, wherein manual intervention is possible, for example, via corresponding keys, particularly arrow keys, on a keyboard or a display, to allow any skewed positioning that may remain to be further corrected. Using the two keys, the product 03 can be moved closer to the stop 09 on either side I or side II, for example, i.e., the braking effect of the brushes 31; 32; 33; 34 on the relevant side I or II can be influenced. A further advantageous development involves the option of manual intervention by the operator so as to improve the brush-out behavior of the product 03 on the folding table 02. In this case, the center brushes 31; 32 (or the two groups 26; 27 that are closer to the intake side) can be moved closer to the folding table 02 or farther away from this, for example, again using arrow keys of an above-described keyboard.

The two modules 38; 39, if both are provided, can be provided separately, but also in a shared control system 54, for example, a brush control mechanism 54, for example, as processes in the same computing and/or storing means.

In an advantageous embodiment, the permissible skew of a product 03 on the folding table 02 can be fixed, for example, at one-half millimeter, but is preferably adjustable. Underneath the folding table 02, the permissible skew is 10 mm, for example.

Particularly advantageous is an embodiment of an apparatus or a method having one or both of the above-described skewed position corrections, which is connected to an above-described apparatus or procedure for controlling the folding time. Advantageously, during each phase of the operation in parallel, but at least during or immediately following the above-described measures for correcting skewed positions, the folding time, i.e., the distance of the product from the stop 09; (46) at the time of first contact in the folding process, is monitored in the manner described above. As soon as one or more brushes 31; 32; 33; 34 presses against the product 03, the brush begins to influence the position of the product 03 on the folding table 02 during folding, under certain circumstances. The product 03 is held back and no longer travels far enough toward the stop 09; (46). In this case, the above-described folding time control, which acts on the folding blade drive, is preferably initiated, and offsets this retention of the product 03 behind its target position, in that the target relative position $\Delta\Phi_R$ is corrected by applying an appropriate correction value $k\Delta$; ($k\Phi$) to it (see above). With a single-stage control of the folding time, correction can be carried out using a correction value $k\Delta$; ($k\Phi$), and with a multistage control of the folding time, correction can be carried out using the control strategy that corresponds to the present phase, and an appropriate correction value $k\Delta x$; ($k\Phi x$), in which x=1, 2, 3, 4, 5. When the position of the product 03 is held back behind the desired position as a result of greater brush pressure, the point of first contact of the folding blade 04 with the product 03 is offset in the direction of the stop 09; (46) by applying a correction value $k\Delta x$; ($k\Phi x$), i.e., the folding blade drive is decelerated at least briefly. Conversely, if the position of the product 03 moves behind the desired position as a result of a lower brush pressure, the point of first contact of the folding blade 04 with the product 03 is offset in the direction of the intake side 18 by applying a correction value $k\Delta x$; ($k\Phi x$), i.e., the folding blade drive is accelerated at least briefly.

If the distance between the first contact point of the folding blade 04 and the stop 09; (46) is too small, there is a great risk of a paper jam occurring in the region of the longitudinal folding apparatus 01. The first contact point of the folding blade 04 is dependent, for example, on the operating frequency (cycles per hour) of the folding blade 04. A recommended value for a safe first contact point is, for example, at least 1 mm distance from the stop 09; (46) per 1,000 cycles/hour operating frequency.

The above-described control of the brushes for correcting skewed position (on and/or underneath the folding table 02) is switched to active, for example, beyond an operating frequency of the folding blade 04 of, for example, 20,000 cycles/hour. In one advantageous embodiment, for the brushes 31; 32; 33; 34 to contact the product 03 at the same time during a start-up phase of production to be carried out, for example, at a speed V of, for example, <1,500 cycles/hour, the brushes can be aligned separately on the two sides of the folding gap 06 (e.g., on side I and side II) in relation to the product 03 to be folded, i.e., adjusted in their distance or set to zero. The aligned value of each brush 31; 32; 33; 34 or brush group 26; 27; 28; 29 is maintained until a production change requiring a readjustment has been carried out at the fold, or until the operator manually resets or changes the truing value.

In what follows, an advantageous device and method for the above-described adjustment or "truing" of the brushes 31; 32; 33; 34 or brush group 26; 27; 28; 29 will be described.

Independently of one or more of the above-described sensors S1; S2; S3; S4; S5; S6, but particularly advantageously in conjunction with some of these, or with all of these, two sensors S7 and S8 that detect the presence of the product 03 on the folding table 02 are provided, which, or the measuring points S7; S8 of which, viewed transversely to the direction of transport T1, are disposed spaced from one another by a distance a7,8 of at least 100 mm, for example, advantageously at least 150 mm, preferably 150 mm to 250 mm, but are preferably disposed substantially symmetrically to the plane E. Preferably, the two sensors S7; S8 or the measuring points S7; S8 are disposed on both sides of the plane E that passes through the longitudinal direction of the folding blade 04, preferably approximately equidistant (up to ±10 mm) therefrom. The two sensors S7 and S8 or the measuring points S7;

S8 thereof are disposed in the same alignment, which extends perpendicular to the direction of transport T1 and/or perpendicular to the plane E. For example, they are disposed at substantially the same vertical distance a03, particularly 3 mm to 10 mm, from a product 03 resting on the folding table 02 between folding table 02 and sensor S7; S8. Preferably, they or the measuring points S7; S8 thereof, viewed in the direction of transport T1, are disposed directly at or immediately upstream of the position of the stop surface, i.e., for example, at most at a distance of 10 mm, preferably at most 5 mm, upstream thereof, when the stop device 09; (46) is in the active status.

One of the two sensors S7; S8, particularly sensor S8, can be dispensed with. In the method for analyzing the two measuring sites S7; S8 relative to one another for the truing process, in place of this measuring point S8 an above-described measuring point can be used, for example, the measuring point S1 of the above-described sensor S1, disposed directly at the stop 09, which can also be used for a different purpose. In this case, the sensor S8 can be dispensed with. Additionally or alternatively, the sensor S7 or the measuring site thereof can be disposed in a position indicated by S7', which can have substantially the same distance a1 (up to ±3 mm) from the plane E as the sensor S1, but is disposed on the other side II of plane E.

In order to allow products 03 of different thicknesses to be taken into consideration in different production runs, while ensuring that the above-mentioned controls function accurately, regardless of numbers of pages, paper weight, asymmetrical products 03, etc., at least the center brushes 31; 32 or the corresponding groups 26; 27 that are closer to the intake side, particularly the groups 26 and 27, are preferably adjusted or "trued" separately in terms of basic vertical adjustment, prior to or during production start-up: This is carried out, for example, at an appropriate speed, for example, at an operating frequency of the folding blade 04 of 2,000-25,000 cycles/hour, for example.

This is accomplished in the manner and method that the brushes 31; 32; (33; 34) or groups 26 and 27 (and, if applicable, 28 and 29) are first moved into a position in which they are not in contact with the product 03 passing through. Each of the four brush systems 26; 27; 28; 29 is then moved downward in sequence, for example, until the detected phase position of the product 03 passing through changes, i.e., a deceleration as compared with the previously observed flow of product is detectable. This phase position change is observed, for example, by the sensors S7 for one side, for example, side I, and sensor S8 (or alternatively S1) for the other side, for example, side II, and is recognized by a corresponding analysis. The position of the brushes 31; 32; (33; 34) or groups 26 and 27; (28; 29) in which this change is first apparent is the position identified above as the trued position. This process is carried out for the two sides I; II in succession. The determined truing values are stored, for example, in a memory device, until they are overwritten by new values, if applicable.

For the stated sensors S0 to S8, the specification and representation of the alignment or position thereof in the folding apparatus 01 is to be understood as synonymous with the position of the measuring site S0 to S8, such that at the output thereof or at the outputs thereof, differentiation can be made between a presence and an absence of the product 03 at the measuring site S0 to S8 monitored by the relevant sensor S0 to S8. Therefore, the sensor S0 to S8 can also be disposed in a position in the folding apparatus 01 that deviates from the illustration, with the provision that it monitors the relevant measuring site S0 to S8 or measuring point S0 to S8 characterized above and in the figures by the sensors S0 to S8. Therefore, the "alignment or position of the sensor"—with the exception of the embodiments relating to the distance a03 from the product 03—can generally be understood as the "alignment or position of the measuring site or measuring position" of the sensor S0 to S8 in question. For example, a sensor S0 to S4, shown disposed above the folding table 02, can also be disposed underneath or in the folding table 02, with a corresponding provision (such as an opening), as long as it monitors the relevant measuring site or measuring point.

The sensor or the stated sensors S0 to S8 is or are preferably embodied as optical sensors, for example, fiber optic sensor(s), advantageously as a reflective type of sensor. Preferably, one variant (particularly for sensors S1; S2; S3; S4; S7; (S7') and S8) is embodied with a convergent light beam, for example, a light spot that can be or is focused on a point, wherein the diameter of the light spot at the focal point is at most 0.7 mm, advantageously at most 0.5 mm, and/or the focal length can be less than 20 mm, advantageously at most 10 mm. Sensors S5 and S6 can be embodied as the same stated type having the same technical parameters, but also with a greater focal length, for example, greater than 20 mm, or under certain circumstances, in a departure from the reflective type, in the form of a photoelectric beam detector.

The stated sensors S0 to S8, as compared with photodiode arrays, line cameras, or surface cameras, need not be sensors that provide spatial resolution, and are instead preferably singular measuring sites spaced from one another, since it is essentially necessary only to determine and analyze passage times.

Nevertheless, for the above-described area of application for skew corrections (on or underneath folding table 02), in a more costly solution a camera system would be conceivable, although—in contrast to systems for analyzing print quality, for example—a camera having low to moderate spatial resolution and/or only black-and-white color capability, in combination with analysis software for recognition of a product edge and for analysis thereof with respect to a skewed position, would be sufficient.

FIGS. 11 to 15 illustrate an advantageous embodiment of the longitudinal folding apparatus 01 from different viewpoints.

As is clear from FIG. 4, for example, in addition to fixed, i.e., stationary, support regions 48, the folding table 02 can have belts 49 that extend parallel to the direction of transport T1 and transport the product 03. Disposed upstream of these, an additional transport device, not shown, for example, a conveyor belt, can be provided, with which the longitudinally folded products 03 are conveyed to the intake region of the intake side 18 or up to the belts 49. As stated above, the folding blade drive is preferably mechanically independent and independently adjustable relative to the drive of the belts 49 and/or the transport device upstream.

On the folding table 02, particularly in a region that is closer to the end of the folding gap 06 that is farther from the intake side, the stop device 09 is provided, which is preferably embodied so as to restrict—at least in an active position, for example—the path of the product 03 along the direction of transport T1.

The stop device 09 has one elongated stop element or a plurality of stop elements 46 disposed side by side, transversely to the first direction of transport T1, wherein the active stop surface that faces a product 03 and is formed by the one stop or the plurality of stops 46 stands substantially in a line perpendicular to the direction of transport T1 and/or perpendicular to the longitudinal direction of the folding gap 06.

The stop element or stop elements 46 is or are embodied as movable via at least one actuator 47, for example, via a pneumatic or hydraulic drive 47. The one or more stop elements 46 can be alternatively engaged or disengaged, with its/their active surface preferably being brought into the plane of motion of the product 03 or removed therefrom, and/or with the distance of its/their stop surface from the intake side 18 alternatively being adjustable in the plane of motion of the product 03. A plurality of actuators 47 can thereby be used to move a plurality of, or plurality of groups of, stop elements 46.

In one advantageous operating situation, the stop device 09 can then be drawn back during folding.

While a preferred embodiment of a method for operating a longitudinal folding apparatus having a folding blade and a folding table, and a longitudinal folding apparatus, all in accordance with the present invention, has been set forth fully and completely hereinabove, it will be apparent to one of skill in the art that various changes in, for example, the specific structure of the printing press or presses used to print the product, the product cutting devices, the product handling devices, and the like, could be made without departing from the true spirit and scope of the present invention which is accordingly to be limited only by the appended claims.

What is claimed is:

1. A method for operating a longitudinal folding apparatus (01) comprising a folding blade (04), a folding table (02) having a folding gap (06), and, on each of the two sides of the folding gap (06), at least one or a group of braking elements (31; 32; 33; 34), wherein the movement of a folding blade (04) is driven in a synchronized manner, with respect to its cyclic motion frequency, in relation to one or more units of a web-processing machine situated upstream thereof and/or a flow of incoming products (03), wherein the entry of a leading edge of incoming products (03) is detected at a first measuring point (S1) in the transport path of the folding table (02), and wherein a relative phase position ΔΦ between the movement of the folding blade (04) and the phase position of the unit or units upstream and/or the phase position of the flow of products is deliberately modified by a control and/or regulating system (10) for the purpose of adjusting a point of contact of the folding blade (04) with the product (03) to be folded, characterized in that the relative phase position ΔΦ is modified by a control algorithm such that, at least in one operating mode or phase of production operation, the leading edges of the products (03) to be folded, which are conveyed on the folding table (02), are held back at a distance from the measuring point (S1) located on the transport path by varying the relative phase position ΔΦ in such a way that, as a result of a detection of the leading edge of one or of a certain number of successive products (03) at this measuring point (S1), the relative phase position ΔΦ is varied to an earlier time for the first contact of product (03) and folding blade (04) and/or the contact point is varied to a point that lies closer to an intake side (18) of the incoming products (03), in that, at a second measuring point (S2), located upstream of the first measuring point (S1) in the direction of transport (T1), the entry of a leading edge of incoming products (03) is also detected, and the relative phase position ΔΦ is varied using a control algorithm, in such a way that, at least in one operating mode or phase of a production operation, the leading edges of the products (03) to be folded, which are conveyed on the folding table (02), are held in a capture area, defined by the two measuring points (S1; S2) that are spaced from one another in the direction of transport (T1), by varying the relative phase position ΔΦ and with single or multiple deliveries from the capture area, the position of the edge in this capture area is moved back for subsequent products (03), and in that a skewed position of the product (03) to be longitudinally folded is corrected by means of a friction-based deceleration implemented by braking elements (31; 32; 33; 34) disposed on both sides of the folding gap (06) and adjustable independently of one another in terms of their distance from the folding table (02) or from the upper side of the folding table and/or from the product (03).

2. The method according to claim 1, characterized in that for this operating mode or phase of a production operation, the product 03 to be folded is to be detected at the second measuring point (S2), one of before and during folding.

3. The method according to claim 1, characterized in that, as a result of the absence of a detection of leading edges at a second measuring point (S2) over a certain period of time, the relative phase position ΔΦ is varied to a later time for first contact and/or the contact point is moved to a point that lies farther away from an intake side (18) for the incoming products (03).

4. The method according to claim 1, characterized in that detection is carried out by sensors (S1; S2).

5. The method according to claim 1, characterized in that in the first operating mode, control is carried out such that, as a result of a detection of a leading edge of a product or a number of successive products (03), variation to an earlier time or closer to the intake side (18) is carried out, so that the leading edge of a subsequently incoming product (03) does not come into contact with a stop (09; 46) that restricts the transport path.

6. The method according to claim 1, characterized in that in a second operating mode, control is carried out after a constant production speed is reached, such that the relative phase position ΔΦ is varied from an earlier time to a later time, until the leading edge of an incoming product (03) is again detected for the first time at the measuring point (S1), and this phase position ΔΦ is then maintained, so that the leading edges of incoming products (03) do not come into contact with a stop (09; 46) that restricts the transport path, or at least strike the stop (09; 46) without significant speed.

7. The method according to claim 1, characterized in that the relative phase position ΔΦ is modified by a relative adjustment of the phase in the drive that effects folding blade movement, particularly by a relative rotation of a drive motor (17) that drives the folding blade, and/or a control cam that controls the folding blade movement.

8. The method according to claim 7, characterized in that the relative phase position ΔΦ is adjusted by an optionally successive application of a correction value kΔ; kΔi; kΦ; kΦi to a target angular position resulting from the guide axis variable, or by an optionally successive modification of the target angular position resulting from the guide axis variable by a correction value kΔ; kΔi; kΦ; kΦi.

9. The method according to claim 8, characterized in that the relative phase position ΔΦ is adjusted by applying another offset value, or by modifying an existing offset value (Δ).

10. The method according to claim 1, characterized in that a target phase position $\Delta\Phi_S$ currently required for the relative phase position ΔΦ is achieved and/or maintained by means of a control loop that compares an actual relative position $\Delta\Phi_I$ with a target relative position ($\Delta\Phi_R$).

11. The method according to claim 10, characterized in that, in the event of a deviation of the actual relative position $\Delta\Phi_I$ particularly of a product phase position $\Phi_P$ and an angular position ($\Phi_A$) of the folding blade drive from the current target relative position ($\Delta\Phi_R$), a correction is made by an optionally successive, relative rotation of the folding blade drive by an angular correction (Δ).

12. The method according to claim 1, characterized in that the adjustment of the relative phase position ΔΦ is accomplished by the optionally successive modification of a relative target phase position ($\Delta\Phi_R$) by a correction value kΔ; kΔi; kΦ; kΦi or by the optionally successive application of a correction value kΔ; kΔi; kΦ; kΦi to a relative target phase position ($\Delta\Phi_R$).

13. The method according to claim 12, characterized in that the relative phase position ΔΦ is adjusted until the condition established by the control algorithm is satisfied.

14. The method according to claim 1, characterized in that the movement of the folding blade is synchronized with the at least one unit upstream on the basis of data relevant to speed and/or angle from an electronic guide axis that connects the drive of the folding blade (04) to the drive of the at least one unit.

15. The method according to claim 1, characterized in that a product phase position $\Phi_P$ of the products (03) conveyed to, into, or within the longitudinal folding apparatus (01) and a phase position ($\Phi_A$) of the folding blade drive are used as the relative phase position ΔΦ.

16. The method according to claim 15, characterized in that the product phase position $\Phi_P$ is determined as the passage of a product, particularly of a leading or trailing edge, at a point in the transport path upstream of the folding process.

17. The method according to claim 15, characterized in that the product phase position $\Phi_P$ is formed as the theoretical product phase position from a phase position of one or more of the units upstream and an offset value.

18. The method according to claim 1, characterized in that the first measuring point (S1) is detected at or immediately upstream of a stop surface that, in the activated state thereof, restricts the transport path (T1).

19. The method according to claim 1, characterized in that the first measuring point (S1) lies at or immediately upstream of a stop surface that, in the activated state thereof, restricts the transport path (T1).

20. The method according to claim 1, characterized in that a correction of a skewed position of a product (03) to be folded on the folding table (02) of the longitudinal folding apparatus (01), and moving along the direction of transport (T1) on the folding table (02), at least prior to folding, is carried out, wherein in each case, a time at which a leading or trailing product edge passes by is detected at two measuring sites (S3; S4) that are spaced from one another transversely to the direction of transport (T1) of the product (03) to be folded, using the passage times detected at the two measuring sites (S3; S4), a deviation Δt1 between a time offset detected with the passage of the observed product edge at the two measuring sites (S3; S4) and a target time offset is determined and analyzed on the basis of control and/or data processing methods, and as a result of a deviation Δt1 that goes beyond at least one tolerance range, a measure that counteracts the deviation Δt1 and influences a particularly asymmetrical deceleration or acceleration of the products (03) moving on the folding table (02) is initiated by means of a control process (38).

21. The method according to claim 1, characterized in that the folding blade (04) is driven by a drive motor (17), mechanically independently of conveyor devices situated upstream of the folding process.

22. The method according to claim 1, characterized in that during an acceleration phase of a web-processing machine situated upstream, a location of a contact point on the folding table (02) or a time of first contact of a product (03) to be folded and the folding blade (04), referred to the product phase position, is adjusted on the basis of a machine speed and/or a machine acceleration.

23. The method according to claim 22, characterized in that the location of the contact point on the folding table (02) or a distance (A) between the contact point and a stop (09; 46) situated downstream is set differently for different speeds.

24. The method according to claim 1, characterized in that during an acceleration phase of a web-processing machine situated upstream, a location of a contact point or the time of first contact of a product (03) to be folded and a folding blade (04) is controlled on the basis of a signal (m1) at a measuring point (S1) located on the folding table (02), such that the contact point is moved closer to the intake side (18) as a result of a signal (m1) that detects the product edge.

25. The method according to claim 1, characterized in that the correction of a skewed position is based upon signals (m3; m4) of third and fourth measuring points (S3; S4), which are different from the first and second measuring points (S1; S2).

26. A method for operating a longitudinal folding apparatus (01), according to claim 1, characterized in that for different operating phases during a production run, a location of a contact point of a product (03) to be folded with a folding blade (04) is controlled according to rules that are different from each other.

27. The method according to claim 26, characterized in that during an acceleration phase, i.e., a phase in which the speed of the machine is increased, the location of the contact point or the time of first contact is controlled.

28. The method according to claim 26, characterized in that during a stationary production phase, i.e., the speed of the machine is constant, the location of the contact point or the time of first contact is controlled.

29. The method according to claim 28, characterized in that during a stationary production phase, i.e., the speed of the machine is constant, the location of the contact point or the time of first contact is controlled.

30. The method according to claim 1, characterized in that the first measuring point (S1) is disposed spaced transversely to the direction of transport (T1) at most by a distance a1 of 100 mm from a plane (E) that passes through the longitudinal direction of the folding blade (04) and preferably extends substantially vertically.

31. The method according to claim 1, characterized in that a skewed position of a product (03) exiting a folding roller gap between two folding rollers (07) of a longitudinal folding apparatus (01) is corrected, wherein the product (03) is pressed into the gap between the folding rollers by the folding blade (04), which can be moved up and down relative to the folding table (02), and said product then leaves the folding roller gap and is conveyed along a direction of transport (T2), wherein at each of two measuring sites (S5; S6) spaced from one another transversely to the direction of transport (T2) of the folded product (03), a time at which a leading or trailing product edge passes through is detected, using the passage times detected at the two measuring sites (S5; S6), a deviation Δt2 between a time offset detected as the observed product edge passes through the two measuring sites (S5; S6) and a target time offset is determined and analyzed by means of control and/or data processing methods, and as a result of a deviation Δt2 that goes beyond at least one tolerance range, a measure that counteracts the deviation Δt2 and involves a stronger or weaker retention of the product (03) as it passes through the folding rollers (07) and/or involves greater or less friction between braking elements (31; 32; 33; 34) and the product (03) is initiated by means of a control process (39).

32. The method according to claim 1, characterized in that folding is carried out when a stop (09; 46), which in its engaged position restricts the transport path, is in its disengaged position.

33. A longitudinal folding apparatus (01) comprising a folding blade (04) and a folding table (02) having a folding gap (06), to which products (03) to be folded can be fed from a first intake side (18) along a first direction of a transport path (T1), wherein a first measuring point (S1) is located one of at and immediately upstream of a stop surface that, in an activated state thereof, restricts the transport path (T1) and a second measuring point (S2) that lies closer to an intake side (18) of the folding table (02) than the first measuring point (S1) are provided, along with a regulating and/or control system (10) assigned to the folding blade drive, and wherein one or more braking elements (31; 32; 33; 34) are provided on each of the two sides of the folding gap (06), characterized in that the folding blade (04) has a folding blade drive for the movement thereof, which is mechanically independent of at least one transport device situated upstream of the folding gap (06) and provided for conveying the products (03) to, into, or within the longitudinal folding apparatus (01), and in that the regulating and/or control system (10) is embodied with an algorithm so as to modify a relative phase position between folding blade drive and product flow, on the basis of signals (m1; m2) that detect the presence of a product leading edge at the first and second measuring points (S1; S2), such that the product leading edge of a subsequent product (03) can still be detected only at the second measuring point (S2), and in that at least two braking elements 31; 32 or groups 26; 27 of braking elements (31; 32) disposed on each of the two sides of the folding gap 06 can be adjusted independently of one another in terms of the distance thereof from the folding table (02) or from the upper side of the folding table and/or from the product (03).

34. The longitudinal folding apparatus according to claim 33, characterized in that the two measuring points (S1; S2) represent singular measuring points (S1; S2), spaced significantly from one another, and/or restrict a capture area, the boundaries of which they monitor.

35. The longitudinal folding apparatus according to claim 33, characterized in that the folding blade drive has a position-controlled drive motor (17), which is synchronized via an electronic guide axis with units situated upstream of the longitudinal folding apparatus (01).

36. The longitudinal folding apparatus according to claim 35, characterized in that a drive control mechanism, which is connected in terms of signals transmission to the electronic guide axis and provides target angular positions to the drive motor (17) is assigned to the drive motor (17), wherein a control process (38) with an algorithm is provided, via which a correction value $k\Delta 1$ or $k\Phi 1$ is applied to the target angular position dependent upon the signals (m1; m2) of the measuring points (S1; S2).

37. The longitudinal folding apparatus (01) according to claim 33, comprising two sensors (S3; S4), which detect the presence of a product (03) to be folded longitudinally, on a transport path along the direction of transport (T1), and which are spaced transversely to the direction of transport (T1) of the product (03) to be guided past, and comprising a control process (38), with which the signals (m3; m4) of these sensors (S3; S4) can be analyzed with respect to a skewed product position, wherein at least one control element is provided, which can be adjusted on the basis of an output signal of the control process (38) for the purpose of influencing a skewed product position on the folding table (02).

38. The longitudinal folding apparatus according to claim 33, characterized in that a device for monitoring and correcting a skewed position of the product (03) to be longitudinally folded on the folding table (02) is provided, which device is different from a stop (09).

* * * * *